US011622613B1

(12) United States Patent
Chung et al.

(10) Patent No.: US 11,622,613 B1
(45) Date of Patent: Apr. 11, 2023

(54) STICK TYPE COSMETIC CONTAINER

(71) Applicants: In Yong Chung, Seoul (KR); Won Eui Lee, Seoul (KR); In Young Um, Seoul (KR); Myung Joong Kim, Pocheon-si (KR); Yeong Min Eom, Siheung-si (KR); Kyung Ho Kang, Suwon-si (KR); Ji Yong Lee, Seoul (KR)

(72) Inventors: In Yong Chung, Seoul (KR); Won Eui Lee, Seoul (KR); In Young Um, Seoul (KR); Myung Joong Kim, Pocheon-si (KR); Yeong Min Eom, Siheung-si (KR); Kyung Ho Kang, Suwon-si (KR); Ji Yong Lee, Seoul (KR)

(73) Assignee: CTK CO., LTD, Seoul (KR)

( * ) Notice: Subject to any disclaimer, the term of this patent is extended or adjusted under 35 U.S.C. 154(b) by 0 days.

(21) Appl. No.: 17/944,973

(22) Filed: Sep. 14, 2022

(30) Foreign Application Priority Data

Mar. 11, 2022 (KR) ..... 10-2022-0030638

(51) Int. Cl.
*A45D 40/12* (2006.01)
*A45D 40/06* (2006.01)

(52) U.S. Cl.
CPC ..... *A45D 40/06* (2013.01); *A45D 40/12* (2013.01)

(58) Field of Classification Search
CPC ..... A45D 40/06; A45D 40/065; A45D 40/12; A45D 40/205
See application file for complete search history.

(56) References Cited

U.S. PATENT DOCUMENTS

| | | | | |
|---|---|---|---|---|
| 5,172,993 | A * | 12/1992 | Ackermann | A45D 40/04 401/78 |
| 9,795,207 | B2 * | 10/2017 | Denece | A45D 40/06 |
| 11,076,679 | B1 * | 8/2021 | Chung | A45D 40/06 |
| 2005/0163554 | A1 * | 7/2005 | Cara Sanchez | A45D 40/04 401/75 |

* cited by examiner

*Primary Examiner* — Jennifer C Chiang
(74) *Attorney, Agent, or Firm* — John K. Park; Park Law Firm

(57) ABSTRACT

A stick type cosmetic container capable of depleting a remaining amount of cosmetics is described. The cosmetic holder has raising and lowering ribs coupled to raising and lowering guide grooves of a protection tubular body, allowing cosmetics to appear and disappear in a proper length. One or more engaging ribs are formed in a stepped shape in the cosmetic holder. A stopper is provided on opposite portions of a flat second side outer circumferential surface of the raising and lowering supporting part and configured to be mutually caught by a lower end of the engagement rib to limit the upward movement of the cosmetics. The cosmetic holder is separably engaged to a tubular body through one or more engagement ribs. The tubular body is configured to be raised independently secondarily while being released from an engagement force from the engagement rib of the cosmetic holder.

14 Claims, 18 Drawing Sheets

[Fig. 1]
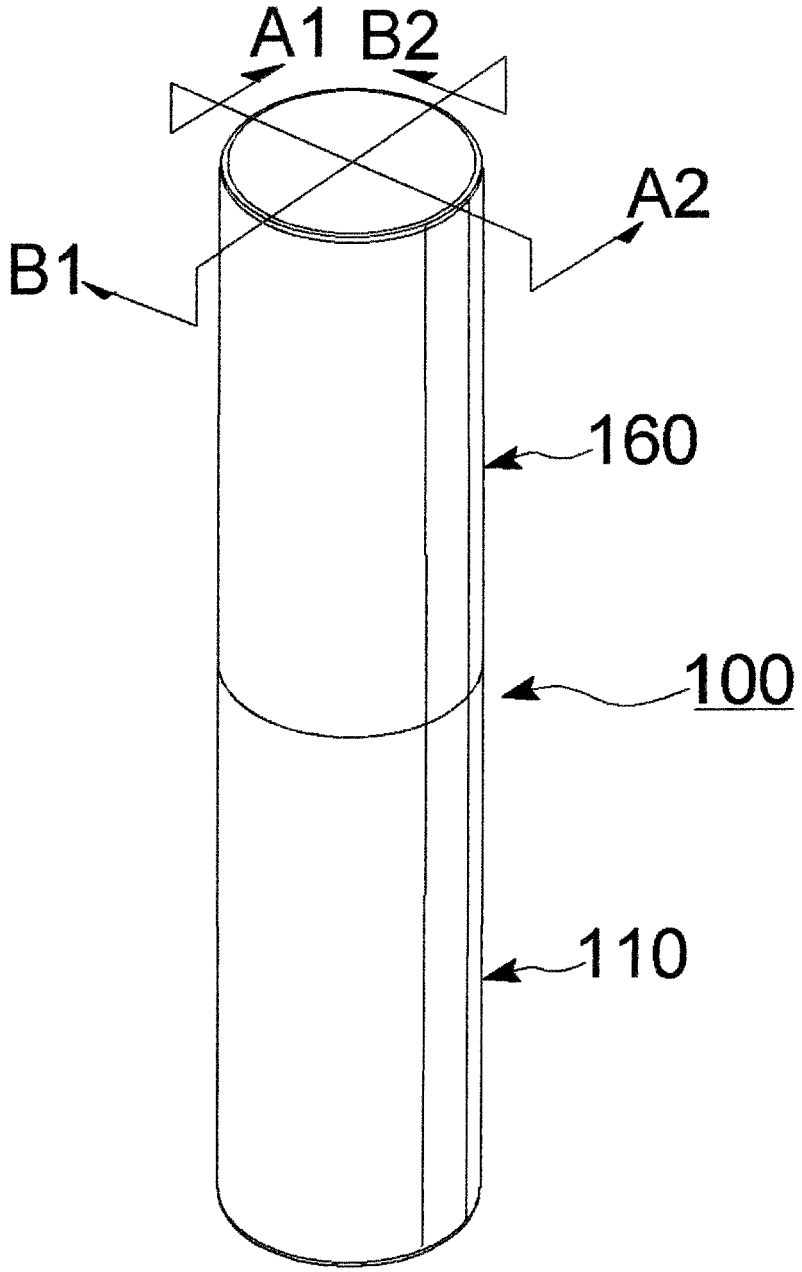

[Fig. 2]
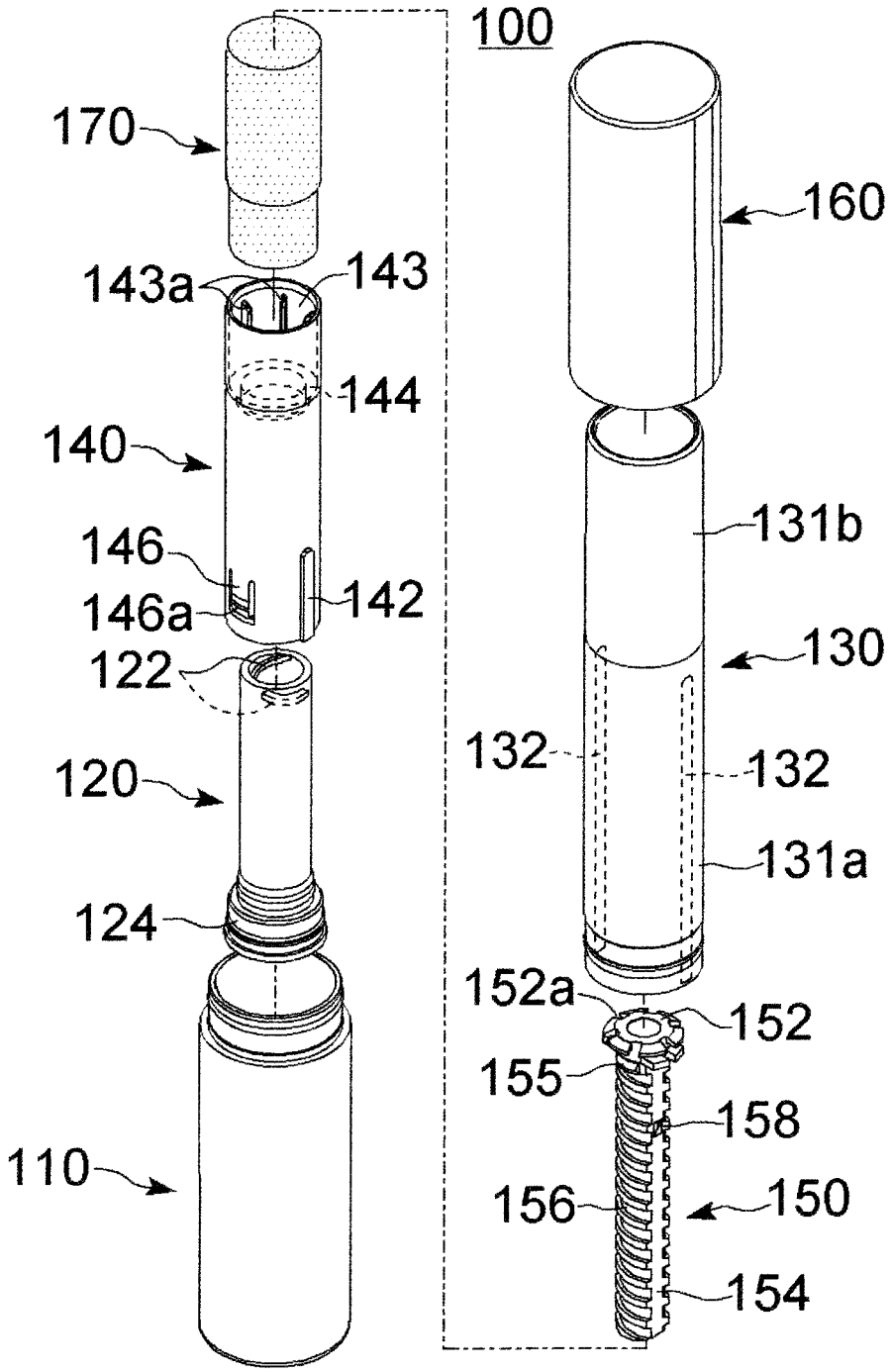

[Fig. 3]
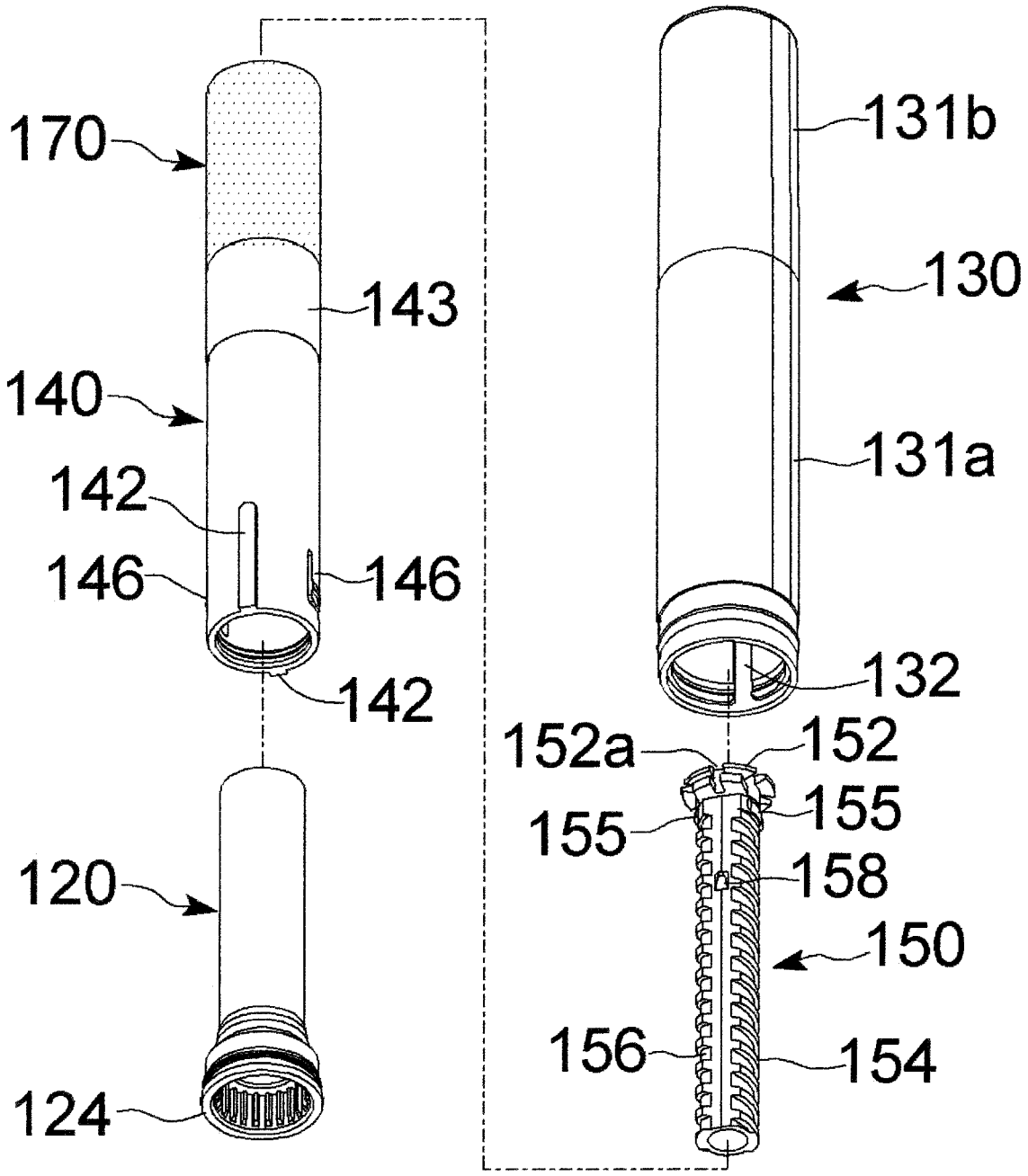

[Fig. 4]
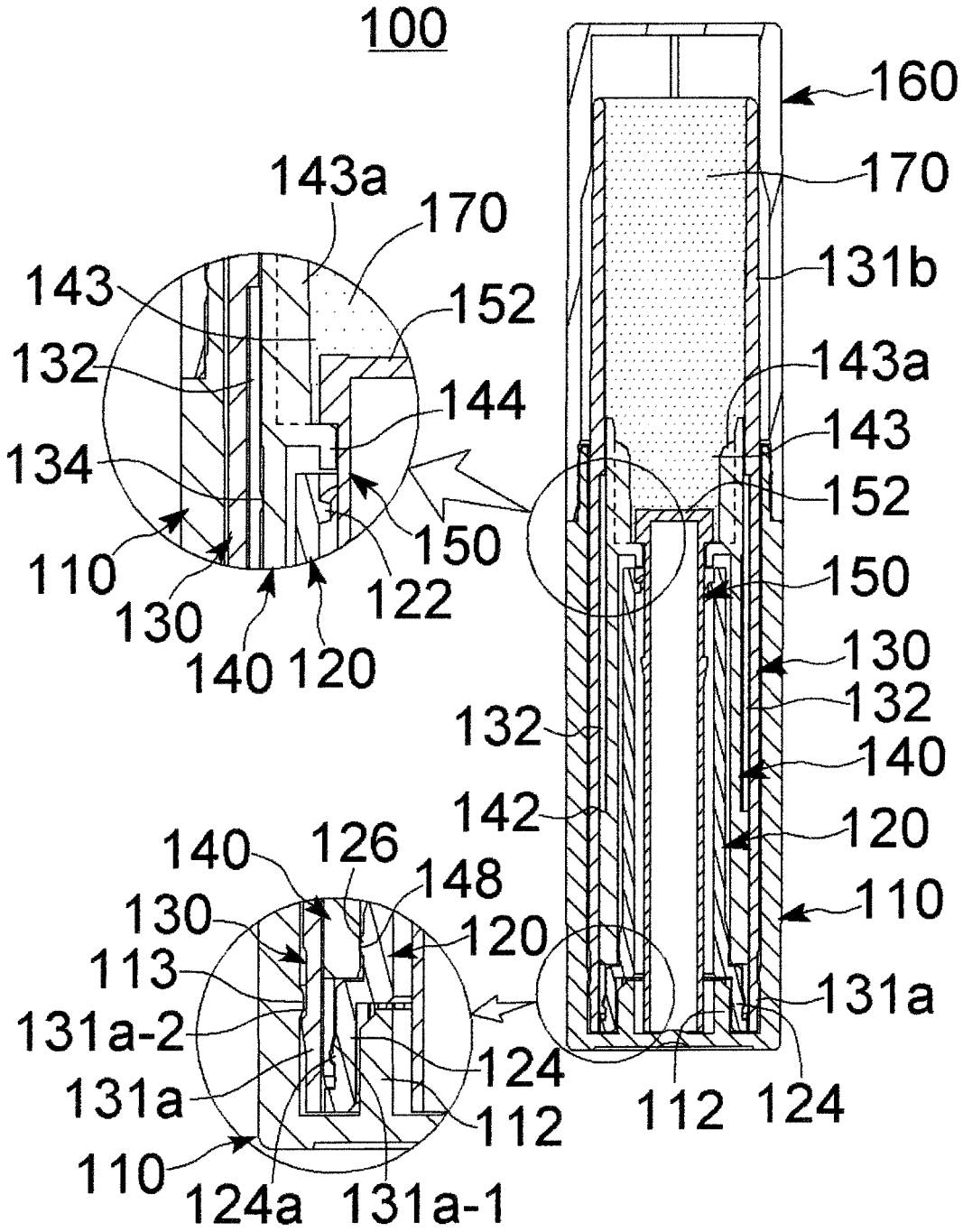

[Fig. 5]
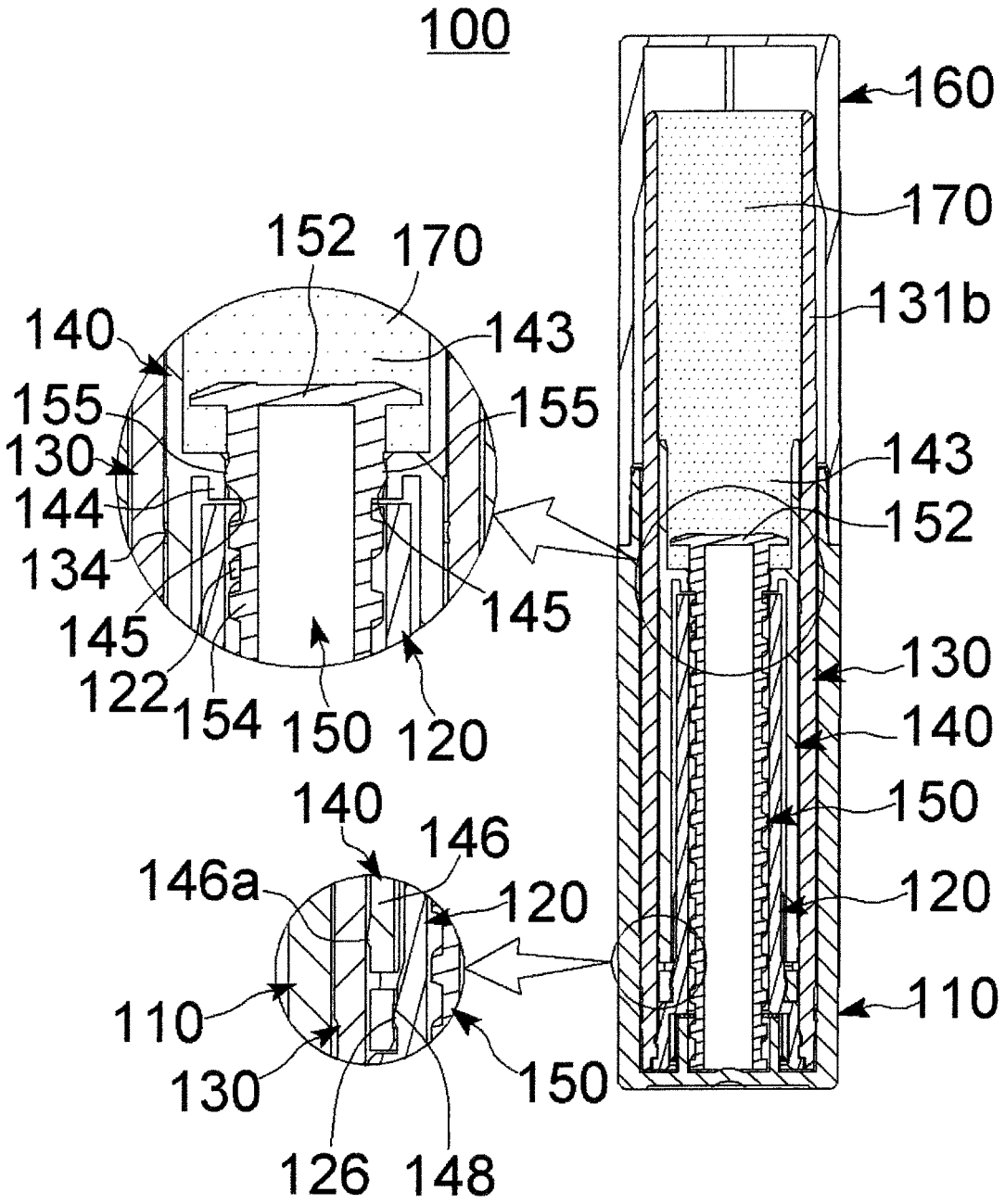

[Fig. 6]
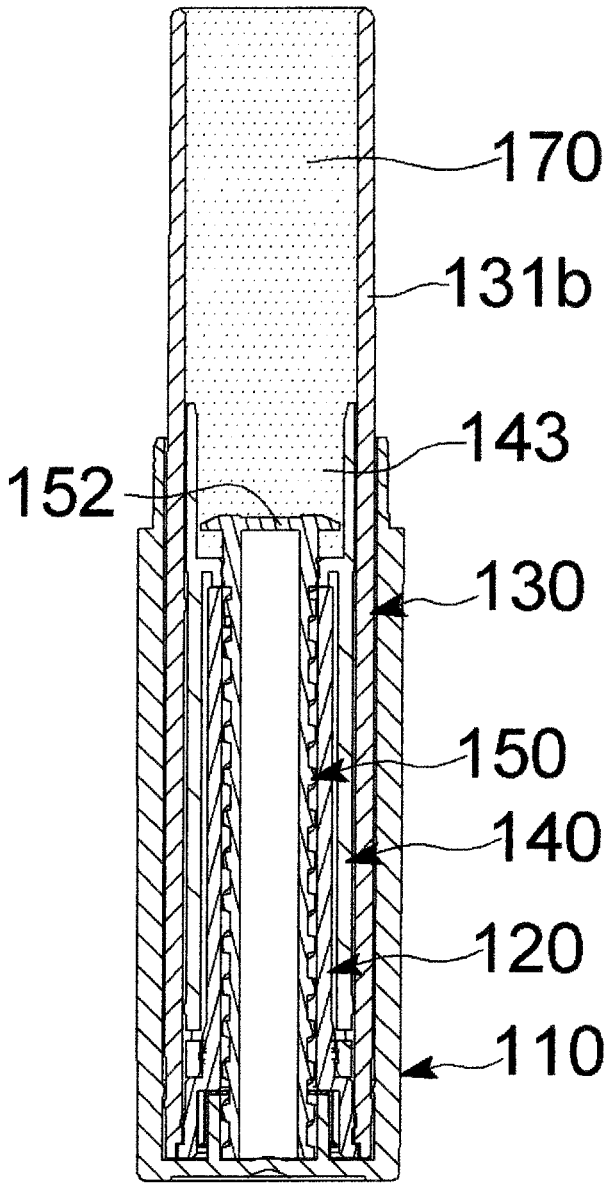

[Fig. 7]
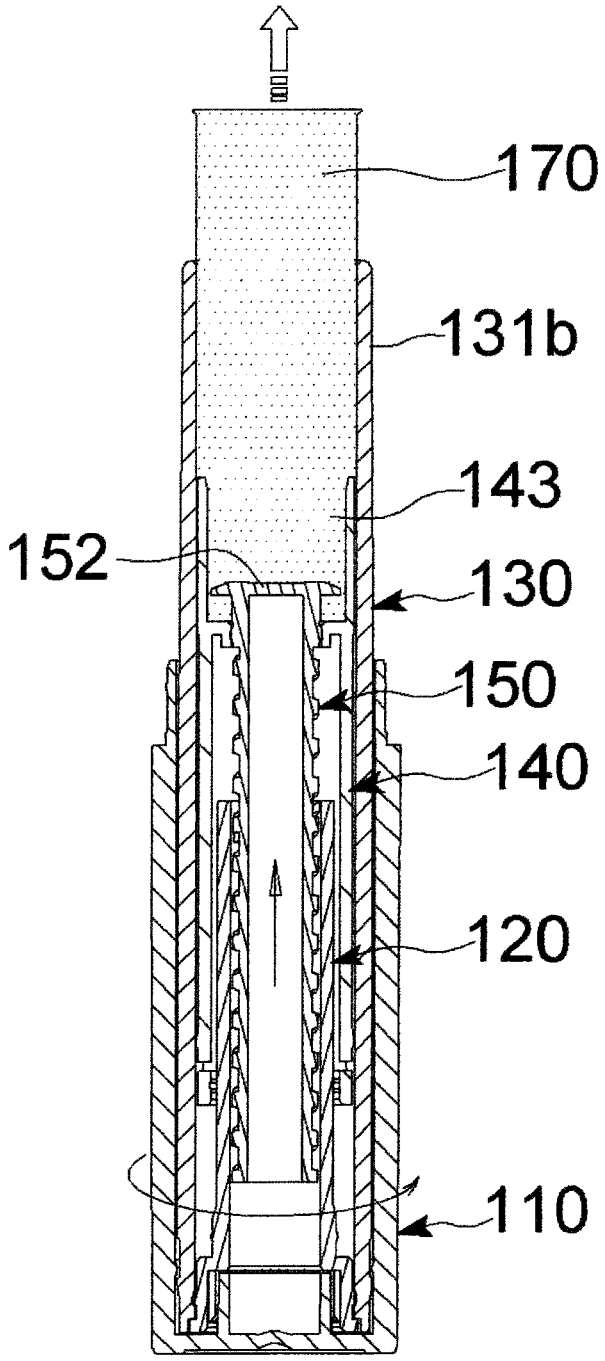

[Fig. 8]
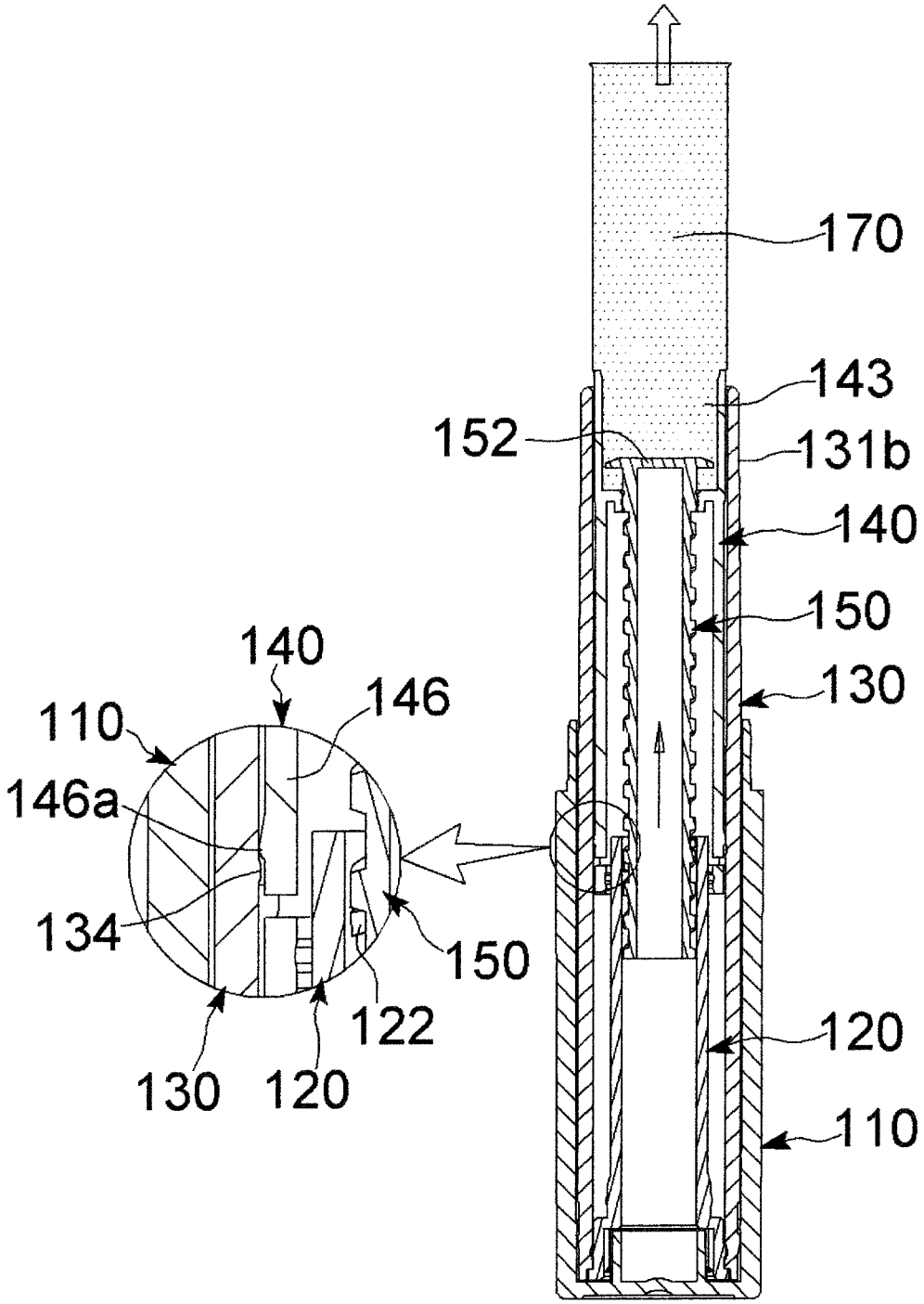

[Fig. 9]
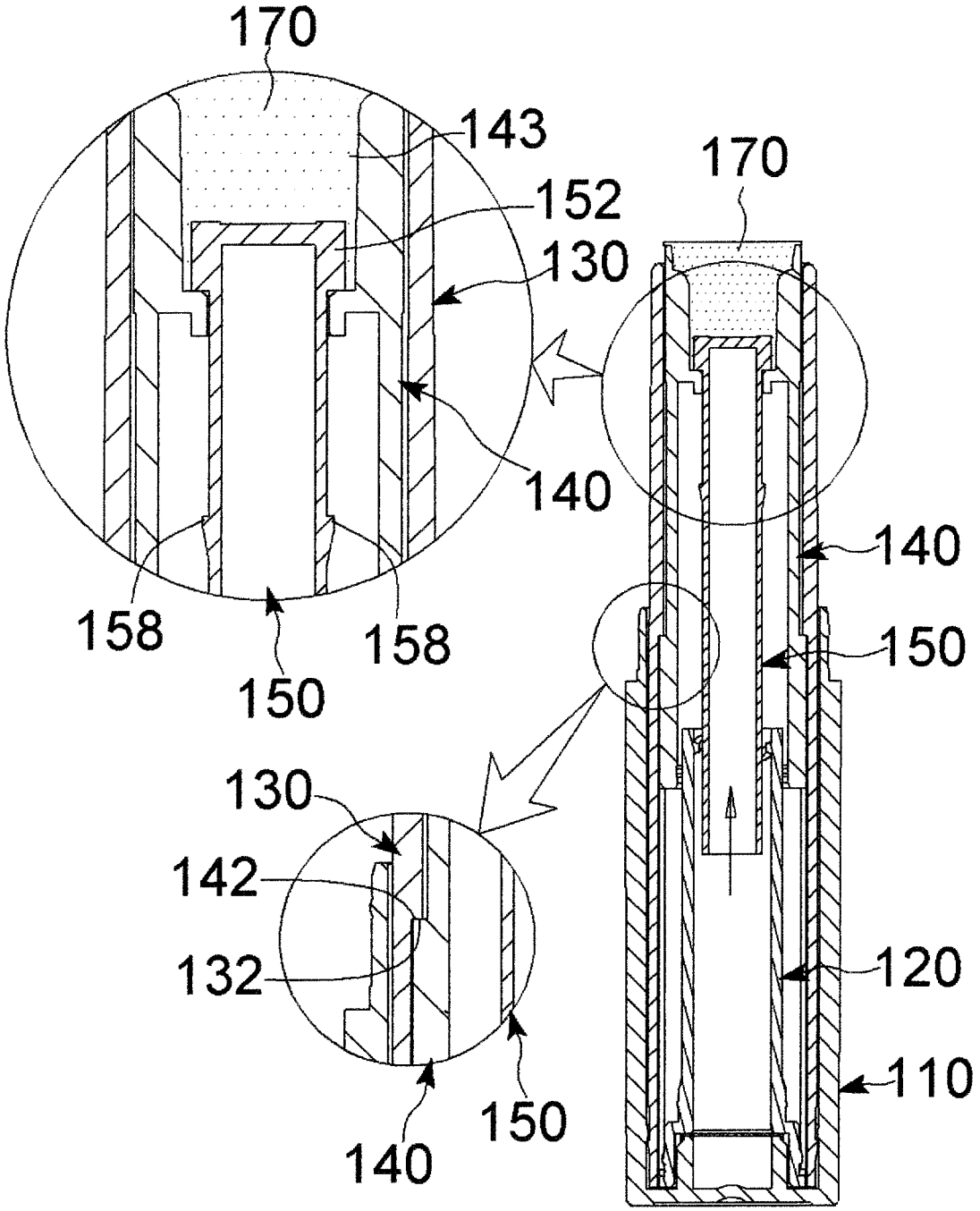

[Fig. 10]
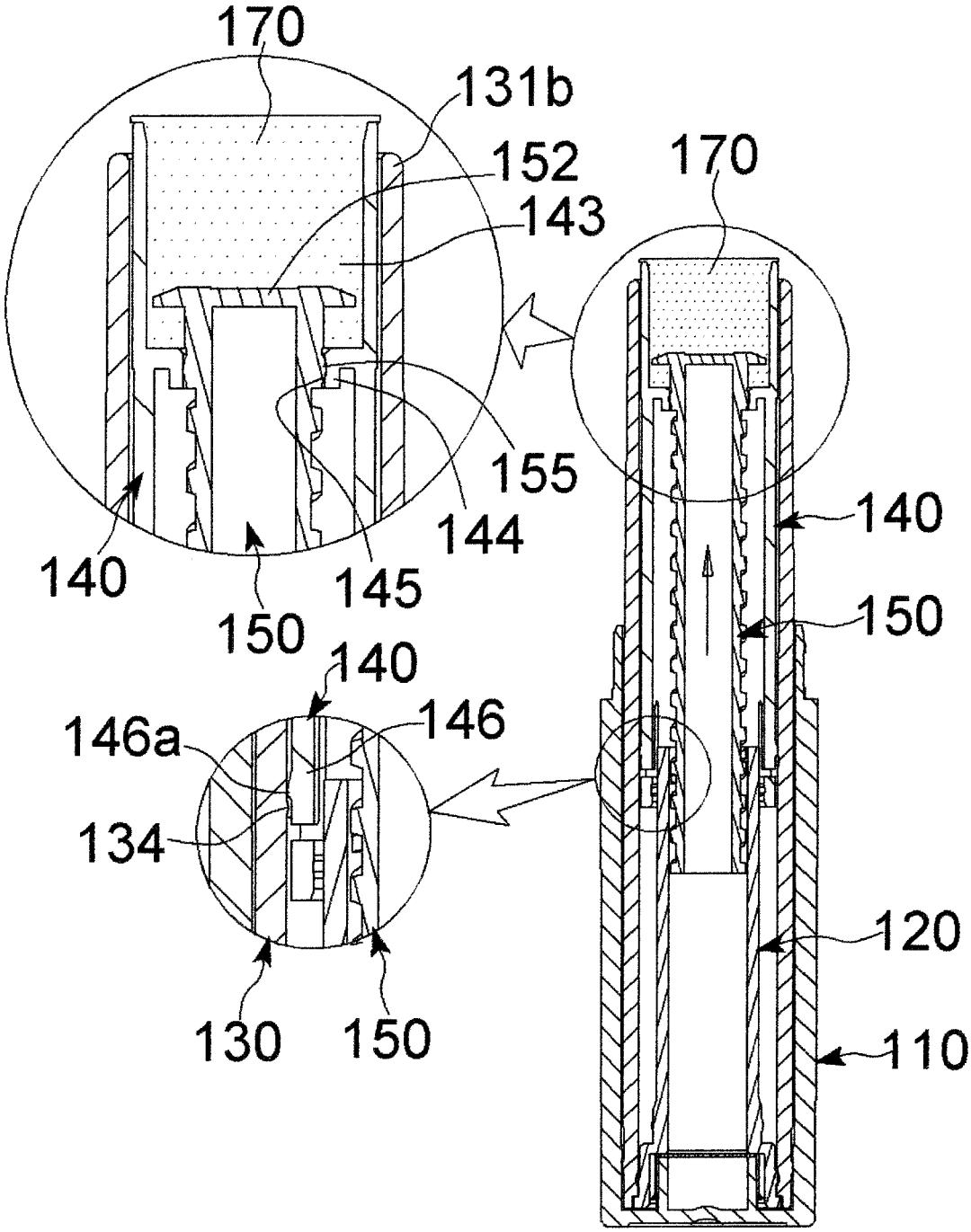

[Fig. 11]
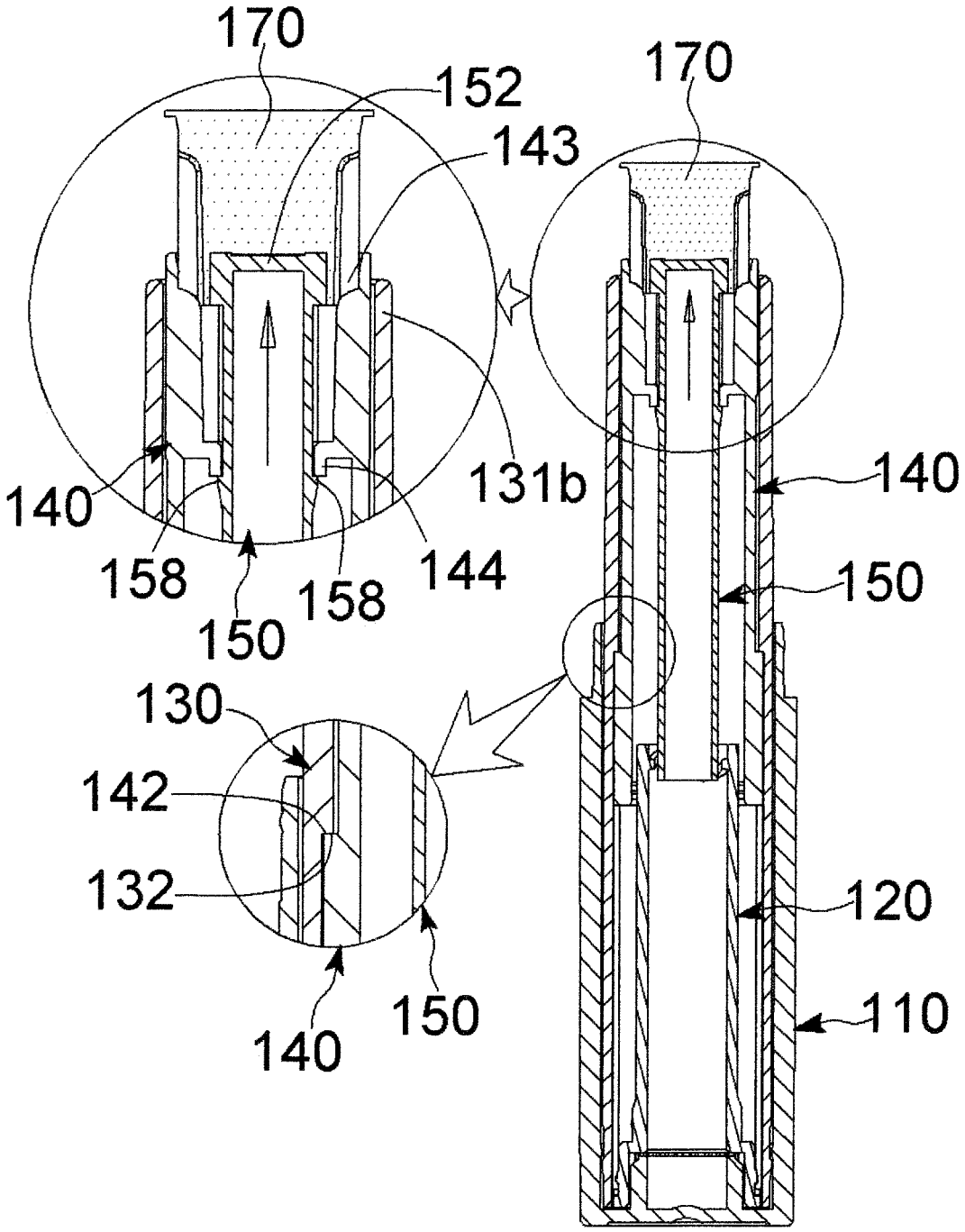

[Fig. 12]
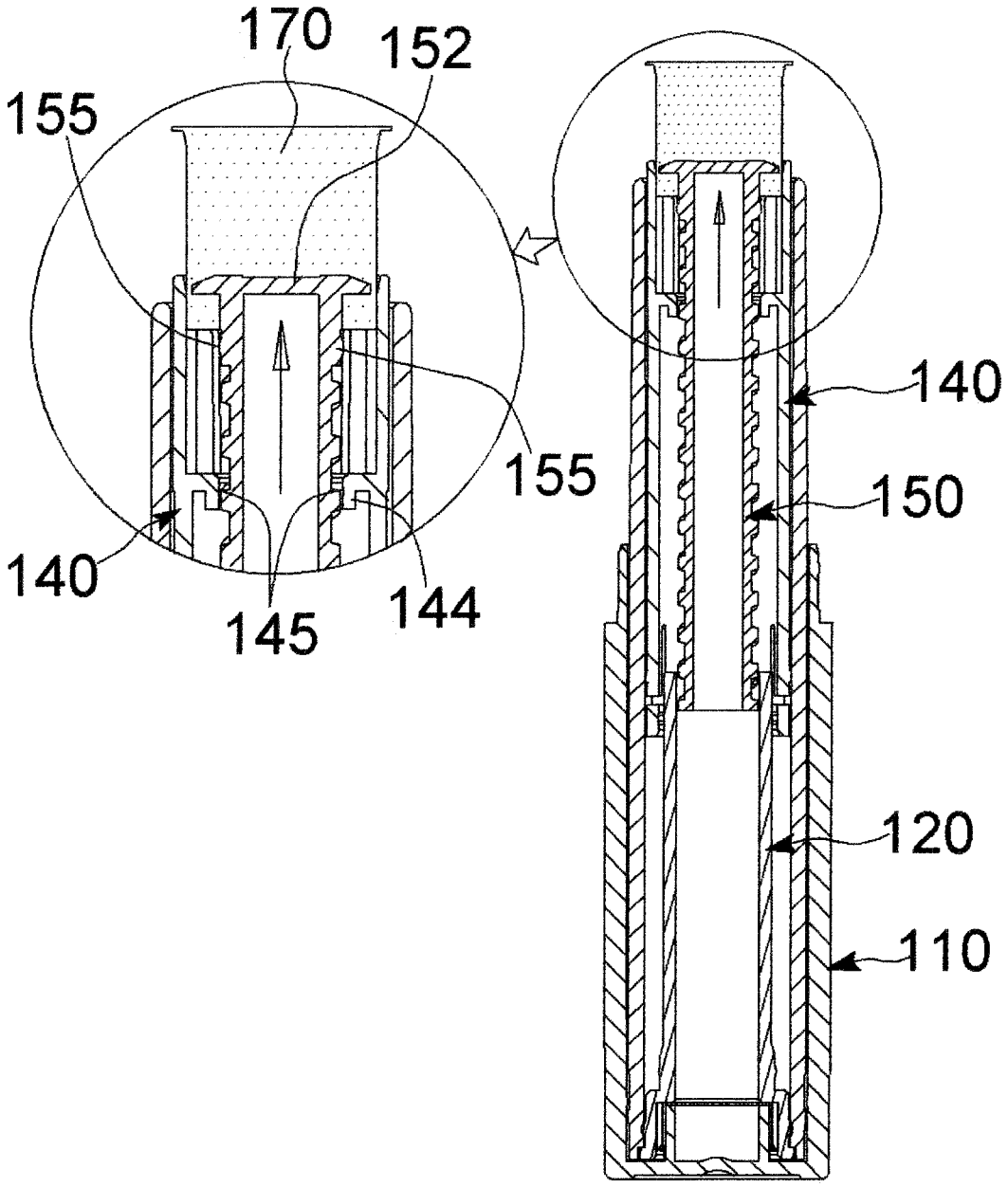

[Fig. 13]
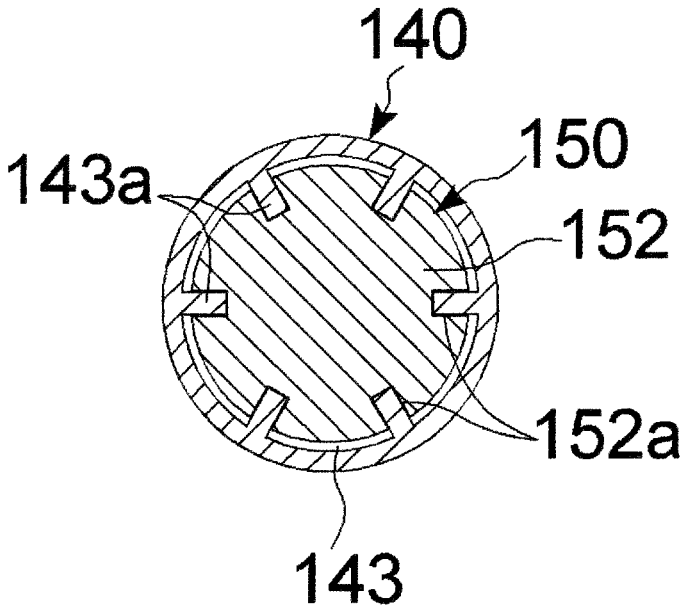

[Fig. 14]
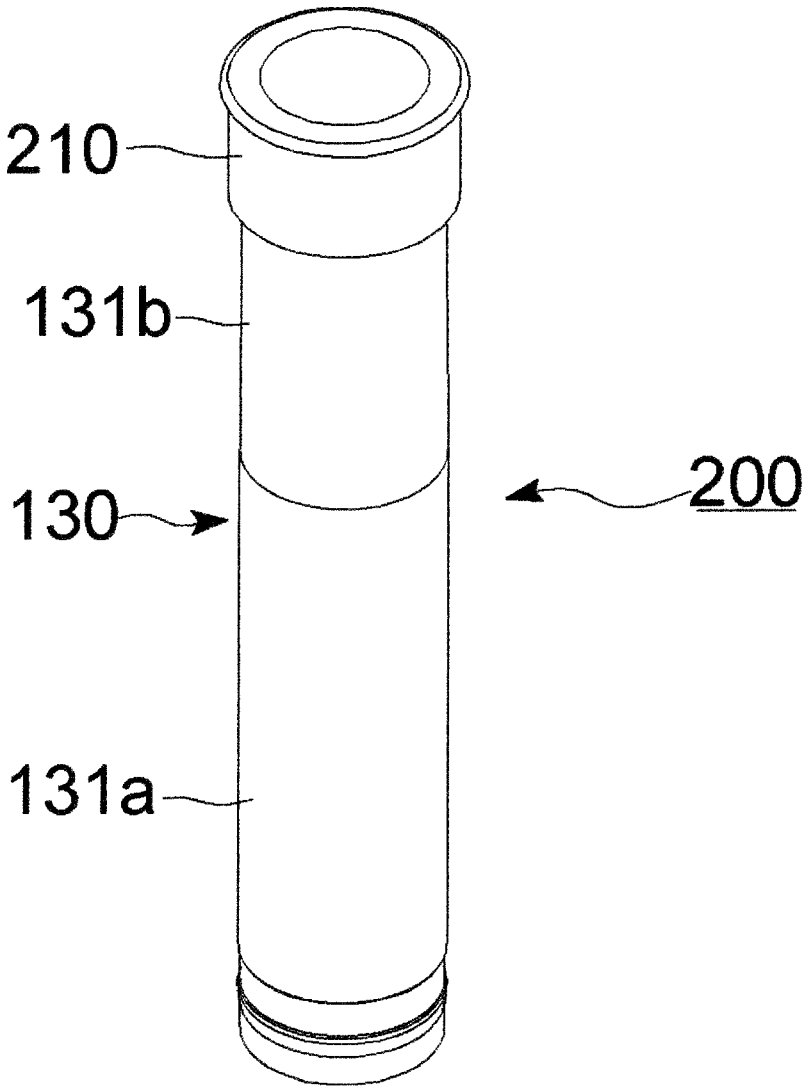

[Fig. 15]
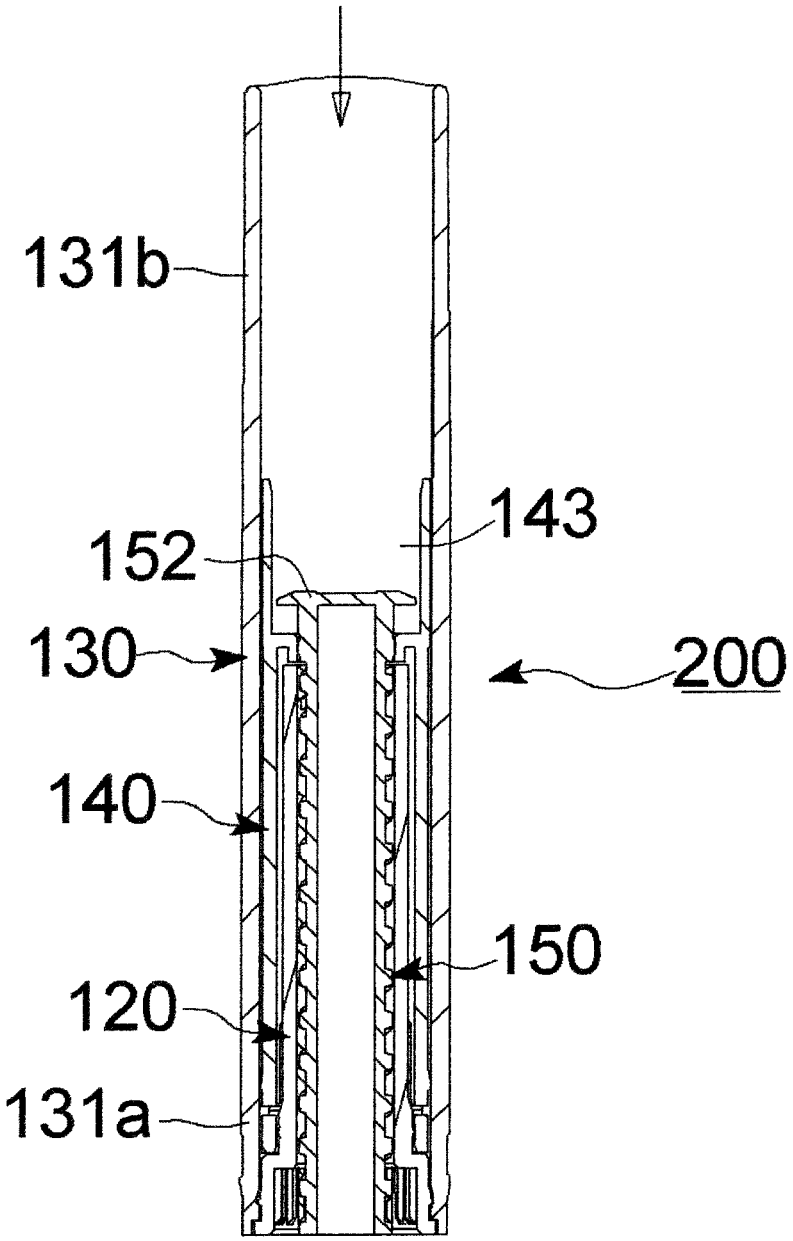

[Fig. 16]
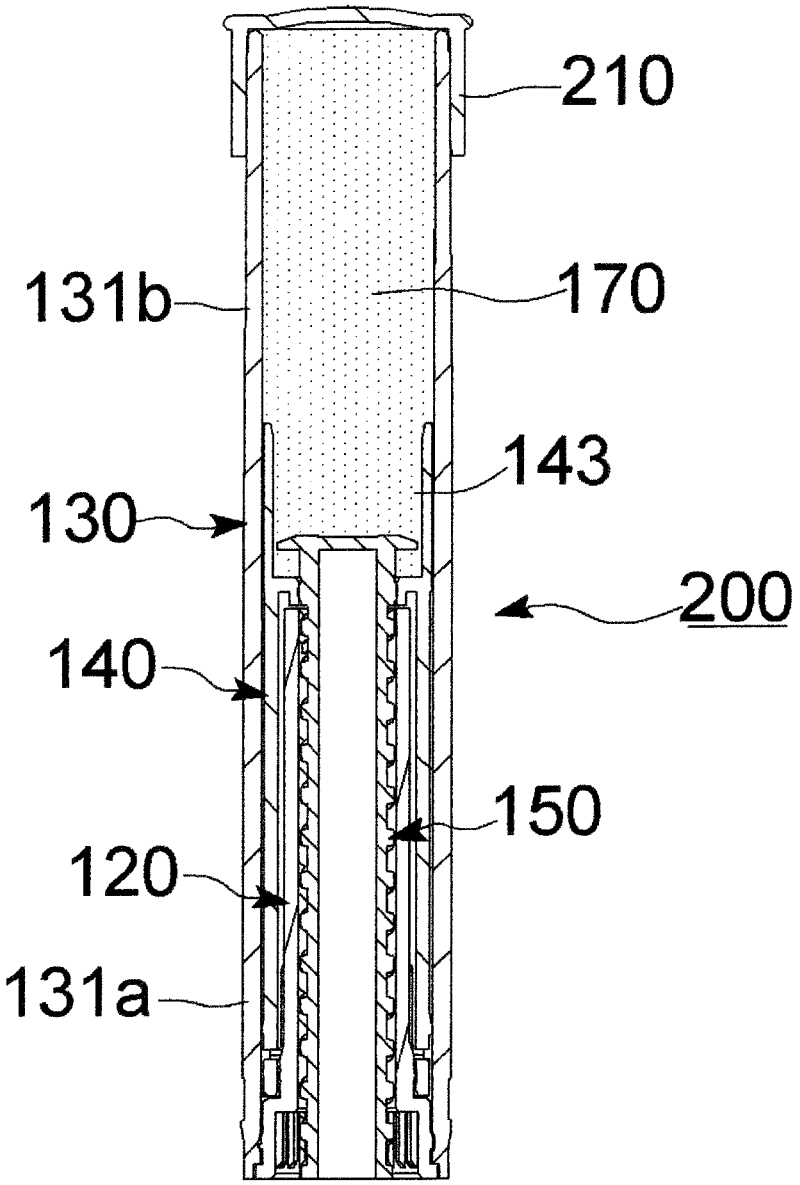

[Fig. 17]
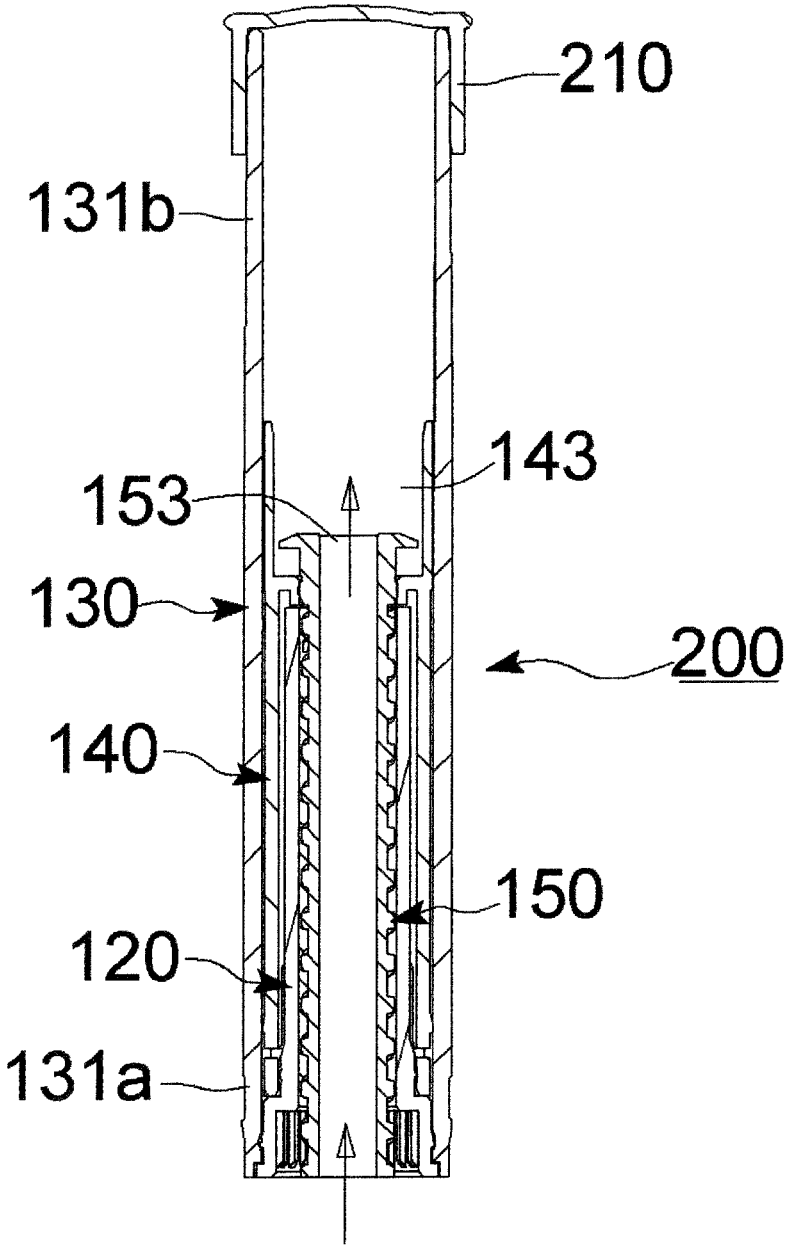

[Fig. 18]
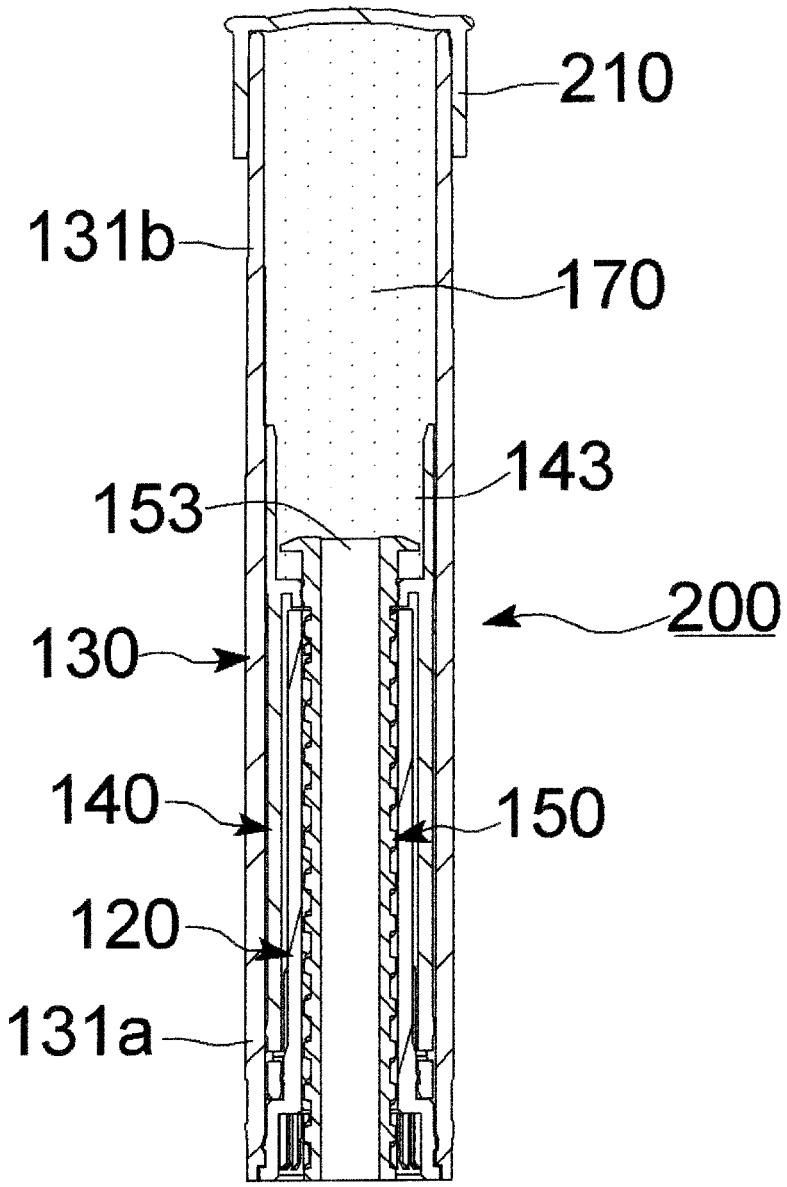

STICK TYPE COSMETIC CONTAINER

TECHNICAL FIELD

The present disclosure relates to a stick type cosmetic container capable of depleting a remaining amount of cosmetics. More particular, the present disclosure relates to a stick type cosmetic container capable of depleting a remaining amount of cosmetics, wherein the stick type cosmetic container has a simple structure improved to stably perform raising and lowering movements and remaining cosmetics depletion for stick type cosmetics and has the assembly stability and ease of use of products.

BACKGROUND ART

In recent, interest in the cosmetic industry is increasing. The above interest is linked to the diversification of distribution networks such as online channels and the improvement of sales performance of domestic cosmetics brands in China and Southeast Asia following the Korean wave. The rise of the domestic cosmetics industry is called K-Beauty and is attracting attention as one of the major market trends.

With respect to cosmetic technology, in addition to the technology for cosmetic compositions or formulas, including natural materials or functional materials, cosmetic containers with improved functionality and usability and methods for manufacturing the same are continuously being developed.

A cosmetic container is a container for accommodating cosmetics or cosmetic tools such as a puff therein, and a shape and a structure thereof are as diverse as the types of cosmetics.

As one of cosmetic containers, there is a stick type cosmetic container. The stick type cosmetic container generally refers to a cosmetic container in which solid or semi-solid cosmetics, such as lipstick, lip gloss, and sun stick, are accommodated in an inner container, and an outer container protects the inner container and the cosmetics.

In the conventional stick type cosmetic container, a significant portion of the cosmetics is not used and is discarded. In addition, in the case of removing the contents, it is cumbersome to dig out the remaining amount of cosmetics with a cotton swab, or to remove the cosmetics after freezing the cosmetics. Above all, due to a cosmetics storage structure of the conventional stick type cosmetic container, the remaining amount of cosmetics is eventually not used up, thereby causing various problems such as waste of cosmetics, environmental pollution due to the disposal of cosmetics, or difficulty in separate collection.

Of course, in order to solve the above problems, several techniques have been proposed (referring to Patent Document 1 and Patent Document 2), but there are still structural limitations in using all of the remaining amount of cosmetics. In addition, various problems in use, such as instability of raising and lowering operation due to the use of a stick type cosmetic, exist in the conventional stick type cosmetic container, and improvement thereof is required.

Accordingly, in the industry, the development of a stick type cosmetic container having a relatively simple and convenient structure while consuming all the remaining amount of cosmetics has been required. Therefore, Patent Document 3 disclosed "stick type cosmetic container that can use remaining amount" proposed by the applicant of the present application, the stick type cosmetic container allows a remaining amount to be consumed while a cosmetic material in the form of a stick filled inside a holder ascending and descending stably ascends and descends. However, although the stick type cosmetic container of Patent Document 3 provides an advanced technique compared to the prior art, it is regrettable that needs of consumers due to additional structure of parts required to raise and lower the cosmetics are satisfied, and improvement of the problem is required.

Documents of Related Art

Patent Document (Patent Document 0001) KR 101915739 B1 (announced on Nov. 6, 2018)

(Patent Document 0002) KR 200484721 Y1 (announced on Oct. 18, 2017)

(Patent Document 0003) KR 102152127 B1 (announced on Dec. 11, 2020)

DISCLOSURE

Technical Problem

Accordingly, the present disclosure has been made keeping in mind the above problems occurring in the related art, and the present disclosure is intended to propose a stick type cosmetic container capable of depleting a remaining amount of cosmetics, wherein the stick type cosmetic container has a simple structure improved to stably perform raising and lowering movements and remaining cosmetics depletion for stick type cosmetics and has the assembly stability and ease of use of products.

Technical Solution

According to the present disclosure, a stick type cosmetic container capable of depleting a remaining amount of cosmetics, the stick type cosmetic container includes: a raising and lowering operation tubular body; and a rotational tubular body rotatably and separably coupled to and supported by an inside space of the raising and lowering operation tubular body, and including a spiral protrusion on an hollow-type inner surface thereof; a protection tubular body of which a lower supporting part may be fitted into the raising and lowering operation tubular body to be separably coupled thereto and supported thereby, and at the same time, and an upper supporting part may be configured to be exposed to an outside space to protect cosmetics manipulated to appear and disappear, and vertical raising and lowering guide grooves may be formed on opposite portions of an inner circumferential surfaces of the lower supporting part; a cosmetic holder slidably disposed between the rotational tubular body and the protection tubular body, and at the same time, including raising and lowering ribs perpendicularly protruding on opposite portions of an outer surface of a lower end thereof in a stepped shape, the raising and lowering ribs being configured to be fitted to be vertically movable with respect to the opposite vertical raising and lowering guide grooves of the protection tubular body, and when the cosmetics are manipulated to be raised, the raising and lowering ribs being caught by the vertical raising and lowering guide grooves to limit the upward movement, and including an engagement rib formed in a stepped shape in a filled space at an upper end of the cosmetic holder in which a part of a lower end of the cosmetics may be filled while being fixed and engagement grooves formed on opposite portions of an inner circumferential surface to face each other; a cosmetic appearing and disappearing manipulation and remaining cosmetic depletion guide tubular body provided through an inside space of the cosmetic holder, and including, while a cosmetic supporting part supporting the lower end of the cosmetics may be seated on and caught by an upper portion of the engagement rib, a hollow raising and lowering supporting part penetrating through and extended downward from a lower end of the cosmetic supporting part, and an engagement protrusion protruding on an one side of an upper end of an outer circumferential surface of the raising and lowering supporting part to be configured to be mutually engaged with the engagement grooves of the engagement rib in an appearing manipulation of the cosmetics, and to be separated from the engagement grooves in remaining cosmetic depleting upward manipulation of the cosmetics, and a spiral groove continuously formed at a lower end of the engagement protrusion to be spirally coupled to the spiral protrusion of the rotational tubular body to enable raising and lowering manipulation, and a stoppers provided on opposite portions of a flat second side outer circumferential surface of the raising and lowering supporting part and configured to be mutually caught by a lower end of the engagement rib to limit upward movement of the cosmetics when residual amount of the cosmetics remaining inside the filled space of the cosmetic holder may be raised; and a protection cap provided at an upper end of the raising and lowering operation tubular body and configured to be manipulated to be opened and closed to protect the cosmetics.

The rotational tubular body, which may be coupled to and supported by the inside space of the raising and lowering operation tubular bod, may be rotatably and separably supported by mutual coupling between a coupling end tube extended from a lower end of the rotational tubular body and a coupling rib extended upward from a bottom in the raising and lowering operation tubular body.

The lower supporting part of the protection tubular body may further include a first locking groove and a second locking groove formed on outer and inner surfaces thereof at a proper coupling distance, and a second locking protrusion and a first locking protrusion may be formed at a location of an outer circumferential surface of a coupling tubular body of the rotational tubular body and a location of an inner circumferential surface of the raising and lowering operation tubular body to correspond to each other, the locations corresponding to the first and second locking grooves, so that the locking grooves and the locking protrusions may be securely coupled to each other.

Tension supporting pieces may be formed to be elastically operated by partially cutting opposite lower portions of the cosmetic holder, and the tension supporting pieces may respectively include outward-protruding first locking steps moving in close contact with an inner circumferential surface of the protection tubular body.

On the inner circumferential surface of the protection tubular body on which the first locking steps of the tension supporting pieces may tension-moves in close contact therewith, in order to allow appearing and disappearing of the cosmetics, second locking steps may further protrude so that the first locking steps may go over the second locking steps in a slidingly contact manner, and step-supported, when the raising and lowering ribs of the cosmetic holder moves upward to the highest point along the vertical raising and lowering guide grooves of the protection tubular body.

The first locking steps formed in the tension supporting pieces of the cosmetic holder and the second locking steps of the protection tubular body may be arranged in a perpendicular direction to locations where the raising and lowering ribs of the cosmetic holder and the vertical raising and lowering guide grooves of the protection tubular body may be arranged, and the first locking steps and the second locking steps may be formed at locations where the first locking steps may go over the second locking steps and be supported simultaneously when the raising and lowering ribs may be step-caught by the vertical raising and lowering guide grooves of the protection tubular body.

In the cosmetic holder with the raising and lowering ribs moving upward to the highest point along the vertical raising and lowering guide grooves of the protection tubular body, when the cosmetic appearing and disappearing manipulation and remaining cosmetic depletion guide tubular body moves downward, as the first locking steps may be supported while being step-caught by the second locking steps of the protection tubular body, the cosmetic holder may be prevented from moving downward by itself, and simultaneously, by rotation of the rotational tubular body, the cosmetic holder may be configured to move downward together with the cosmetic appearing and disappearing manipulating and remaining cosmetic depletion guide tubular body only in downward movement operation of the cosmetic appearing and disappearing manipulation and remaining cosmetic depletion guide tubular body, so that the cosmetic holder may be configured to stably perform fixing and supporting of the cosmetics.

The rotational tubular body and the cosmetic holder respectively may include third locking protrusions and third locking grooves that may be formed to correspond to each other and be configured to be locked to each other, wherein during product distribution or unintended external force, the cosmetic appearing and disappearing manipulation and remaining cosmetic depletion guide tubular body spirally coupled to the spiral protrusion of the rotational tubular body may be prevented from being arbitrary manipulated to appear and disappear by restraining arbitrary rotation of the rotational tubular body due to the raising and lowering operation tubular body.

At least one fixing rib may be radially arranged at an inner circumferential surface of the filled space of the cosmetic holder, and a slit may be formed by cutting the cosmetic supporting part of the cosmetic appearing and disappearing manipulation and remaining cosmetic depletion guide tubular body, so that the fixing rib may be fitted into the slit.

Except for the raising and lowering operation tubular body and the protection cap, the rotational tubular body, the protection tubular body, the cosmetic holder, and the cosmetic appearing and disappearing manipulation and remaining cosmetic depletion guide tubular body may be assembled into one cosmetic filling unit, and the cosmetic filling unit may be configured such that the cosmetics may be top-filled from an upper portion of the protection tubular body into the filled space of the cosmetic holder.

Except for the raising and lowering operation tubular body and the protection cap, the rotational tubular body, the protection tubular body, the cosmetic holder, and the cosmetic appearing and disappearing manipulation and remaining cosmetic depletion guide tubular body may be assembled into one cosmetic filling unit, and the cosmetic filling unit may be configured such that a filling through hole may be formed in the cosmetic supporting part of the cosmetic appearing and disappearing manipulation and remaining cosmetic depletion guide tubular body, an airtight cap may be coupled to an upper end of the protection tubular body, and then the cosmetics may be back-filled into the filled space of the cosmetic holder from a lower portion of the rotational tubular body.

A stick type cosmetic container capable of depleting a remaining amount of cosmetics, the stick type cosmetic container may include: a spiral protrusion of a rotational tubular body, which rotates in conjunction with a raising and lowering operation tubular body rotating in one direction, configured to allow a cosmetic appearing and disappearing manipulation and remaining cosmetic depletion guide tubular body to which a spiral groove of a raising and lowering supporting part may be spiral-coupled to be vertically raised, the cosmetic appearing and disappearing manipulation and remaining cosmetic depletion guide tubular body may be raised and, at the same time, a cosmetic holder separably engaged to the cosmetic appearing and disappearing manipulation and remaining cosmetic depletion guide tubular body through an engagement rib may be configured such that raising and lowering ribs may be also raised within a range of vertical raising and lowering guide grooves of a protection tubular body, and cosmetics filled in a filled space of the cosmetic holder are exposed outward of an upper supporting part of the protection tubular body by a raised distance of the raising and lowering ribs, both the cosmetic appearing and disappearing manipulation and remaining cosmetic depletion guide tubular body and the cosmetic holder are lowered as the raising and lowering operation tubular body may rotate in a reverse direction, and thus the cosmetics may be manipulated to properly appear and disappear as the cosmetics may be introduced into the upper supporting part of the protection tubular body, and when the cosmetic holder is raised first to a highest point by the vertical raising and lowering guide grooves, by continuously rotating the raising and lowering operation tubular body in one direction, the cosmetic appearing and disappearing manipulation and remaining cosmetic depletion guide tubular body may be configured to be raised independently secondarily while being released from an engagement force from the engagement rib of the cosmetic holder to push the cosmetics remaining in the filled space to the outside space to deplete or remove the remaining cosmetics.

In appearing operation of the cosmetics, the cosmetic holder may be stabilized by the structure of the raising and lowering ribs of the cosmetic holder fitted in the vertical raising and lowering guide grooves of the protection tubular body and the structure of a tension supporting pieces with first locking steps that may be arranged perpendicular to the raising and lowering ribs and in elastically contact with an inner circumferential surface of the protection tubular body, so that balanced raising and lowering movements are possible.

The cosmetic appearing and disappearing manipulation and remaining cosmetic depletion guide tubular body raised secondarily may be configured such that the stoppers formed in the raising and lowering supporting part may be freely raised and lowered within a range of being held within the range of being locked at a lower end of the engagement rib of the cosmetic holder, and configured to push the cosmetics remaining in the filled space to the outside space to deplete and remove the remaining cosmetics.

Advantageous Effects

According to the present disclosure, operational structure is improved according to raising and lowering movements and remaining cosmetics depletion for stick-shaped cosmetics can be operated to stably appear and disappear without an additional part, and it is possible to provide the assembly stability and ease of use of products.

Furthermore, as the raising and lowering ribs of the cosmetic holder are slidably coupled to the vertical raising and lowering guide grooves formed in the inner circumferential surface of the protection tubular body, when the spiral groove of the cosmetic appearing and disappearing manipulating and remaining cosmetic depletion guide tubular body is manipulated to raise and lower by the spiral protrusion of the rotational tubular body in appearing and disappearing manipulation of cosmetics, even when fine moving is generated due to a spiral coupling movement, the cosmetic holder can maintain the stable vertical raising and lowering state of cosmetics and shaking and moving of the cosmetics can be prevented.

Furthermore, when cosmetics are operated to appear and disappear, stable and balanced vertical movement of the cosmetic holder can be formed with respect to the protection tubular body by the structure of the vertical raising and lowering guide grooves of the protection tubular body and the raising and lowering ribs and the structure of the tension supporting pieces provided in the cosmetic holder.

Furthermore, raising movement of the cosmetic holder to the highest point due to cosmetic appearing and disappearing operation can be detected by the structure of the tension supporting pieces provided in the cosmetic holder. Accordingly, additional raising timing can be provided to deplete cosmetics remaining in the filled space in the cosmetic holder.

Furthermore, when the cosmetic holder is raised to the highest point, the first locking steps formed in the tension supporting pieces is maintained to be held by the second locking steps formed in the protection tubular body, so that the cosmetic holder are not lowered by itself, and as the cosmetic holder is lowered only by the cosmetic appearing and disappearing manipulating and remaining cosmetic depletion guide tubular body, the raising and lowering operation stability of the cosmetic holder is increased and the cosmetics in the raising state can be stably protected and supported.

Furthermore, during product distribution or unintended external force, by the structure in which the third locking protrusions and the third locking grooves are provided in the rotational tubular body and the third locking protrusions provided in the cosmetic holder, the arbitrary operation limitation of the rotational tubular body is limited by the raising and lowering operation tubular body, and the cosmetic appearing and disappearing manipulating and remaining cosmetic depletion guide tubular body spiral-coupled to the spiral protrusion of the rotational tubular body can be prevented from being arbitrary raised and lowered

DESCRIPTION OF DRAWINGS

FIG. 1 is an assembled-external perspective view according to the present disclosure.

FIG. 2 is an exploded-perspective view according to the present disclosure.

FIG. 3 is an exploded-bottom-perspective view showing a selective main part according to the present disclosure.

FIG. 4 is an assembled-sectional view taken along line A1-A2 in FIG. 1.

FIG. 5 is an assembled-sectional view taken along line B1-B2 in FIG. 1.

FIG. 6 is an assembled-sectional view showing a state without a protection cap on the basis of the section of B1-B2 line in FIG. 1.

FIG. 7 is an assembled-sectional view showing a state in which a raising and lowering manipulation cap rotates in one direction from the state in FIG. 6 to raise cosmetics by a predetermined distance.

FIG. 8 is an assembled-sectional view showing a state in which a cosmetic holder moves upward to the highest point from the state in FIG. 7.

FIG. 9 is an assembled-sectional view showing that when the protection cap is removed, the cosmetic holder performs first upward movement to the highest point to deplete remaining amount of cosmetics on the basis of the section of line A1-A2 in FIG. 1.

FIG. 10 is an assembled-sectional view showing that when the protection cap is removed, the cosmetic holder performs the first upward movement to the highest point to deplete remaining amount of cosmetics on the basis of the section of line B1-B2 in FIG. 1.

FIG. 11 an assembled-sectional view showing that a cosmetic appearing and disappearing manipulating and remaining cosmetic depletion guide tubular body performs second upward movement independently from the cosmetic holder from the state in FIG. 9 and thus the cosmetics is exposed to the outside space.

FIG. 12 an assembled-sectional view showing that the cosmetic appearing and disappearing manipulating and remaining cosmetic depletion guide tubular body performs the second upward movement independently from the cosmetic holder from the state in FIG. 10 and thus the cosmetics is exposed to the outside space.

FIG. 13 is a cross-sectional view showing a state in which fixing ribs of the cosmetic holder according to the present disclosure and slits formed in a cosmetic supporting part of the cosmetic appearing and disappearing manipulating and remaining cosmetic depletion guide tubular body are fitted to each other.

FIG. 14 is an assembled-perspective view showing the exterior with a cosmetic filling unit structure according to the present disclosure.

FIGS. 15 and 16 are assembled-sectional views showing after and before the cosmetics are filled from the top by using the cosmetic filling unit according to the present disclosure.

FIGS. 17 and 18 are assembled-sectional views showing after and before the cosmetics are back-filled by using the cosmetic filling unit according to the present disclosure.

BEST MODE

Hereinbelow, an exemplary embodiment of the present disclosure will be described in detail with reference to accompanying drawings.

Referring to FIGS. 1 to 13, according to the present disclosure, a stick type cosmetic container 100 capable of depleting a remaining amount of cosmetics includes: a raising and lowering operation tubular body 110; a rotational tubular body 120 coupled to and supported by the raising and lowering operation tubular body 110 to be rotatable with and separable from the inside space of the raising and lowering operation tubular body 110, and at the same time, including a spiral protrusion 122 formed on a hollow inner circumferential surface of the rotational tubular body 120; a protection tubular body 130 including a lower supporting part 131*a* fitted into the raising and lowering operation tubular body 110 to be separably coupled and supported, and an upper supporting part (131*b*) exposed to the outside space and protecting cosmetics 170 that is manipulated to appear and disappear, and vertical raising and lowering guide grooves 132 formed on opposite portions of an inner circumferential surface of the lower supporting part 131*a*; a cosmetic holder 140 disposed between the rotational tubular body 120 and the protection tubular body 130 in a slidable manner, and including raising and lowering ribs 142 formed by perpendicularly protruding in a stepped shape on opposite portions of an outer circumferential surface of a lower end of the cosmetic holder 140, the raising and lowering ribs 142 being fitted into the opposite vertical raising and lowering guide grooves 132 of the protection tubular body 130 to be vertically movable and in upward movement manipulation of the cosmetics 170, the raising and lowering ribs 142 being caught by the vertical raising and lowering guide grooves 132 to limit the upward movement of the cosmetics 170, and the cosmetic holder 140 including an engagement rib 144 formed in a stepped shape in a filled space 143 at an upper portion into which the cosmetics 170 is filled while a lower end thereof is partially fixed, and engagement grooves 145 formed on opposite portions of an inner circumferential surface to face each other; a cosmetic appearing and disappearing manipulation and remaining cosmetic depletion guide tubular body 150 provided through an inside space of the cosmetic holder 140, and including, while a cosmetic supporting part 152 supporting the lower end of the cosmetics 170 is seated on and caught by an upper portion of the engagement rib 144, a hollow raising and lowering supporting part 154 penetrating through and extended downward from a lower end of the cosmetic supporting part 152, and an engagement protrusion 155 protruding on an one side of an upper end of an outer circumferential surface of the raising and lowering supporting part 154 to be configured to be mutually engaged with the engagement grooves 145 of the engagement rib 144 in an appearing manipulation of the cosmetics 170, and to be separated from the engagement grooves 145 in remaining cosmetic depleting upward manipulation of the cosmetics 170, and a spiral groove 156 continuously formed at a lower end of the engagement protrusion 155 to be spirally coupled to the spiral protrusion 122 of the rotational tubular body 120 to enable raising and lowering manipulation, and a stoppers 158 provided on opposite portions of a flat second side outer circumferential surface of the raising and lowering supporting part 154 and configured to be mutually caught by a lower end of the engagement rib 144 to limit upward movement of the cosmetics 170 when residual amount of the cosmetics 170 remaining inside the filled space 143 of the cosmetic holder 140 is raised; and a protection cap 160 provided at an upper end of the raising and lowering operation tubular body 110 and configured to be manipulated to be opened and closed to protect the cosmetics.

According to the present disclosure, the rotational tubular body 120, which is coupled to and supported by the inside space of the raising and lowering operation tubular body 110, may be rotatably and separably supported by mutual coupling between a coupling end tube 124 extended from a lower end of the rotational tubular body 120 and a coupling rib 112 extended upward from a bottom in the raising and lowering operation tubular body 110.

Herein, the coupling end tube 124 of the rotational tubular body 120 and the coupling rib 112 of the raising and lowering operation tubular body 110 may be configured to be rotatable with or separable from each other by a coupling means formed such that the outer and inner circumferential surfaces correspond to each other, for example, a spline coupling method, serration coupling method, or variously shaped coupling structures serving the same function.

Therefore, the rotational tubular body 120 is rotatably manipulated when the raising and lowering operation tubular body 110 is rotatably manipulated while being grabbed, and when necessary, the rotational tubular body 120 may be separable from the raising and lowering operation tubular body 110.

The protection tubular body 130 safely protects the cosmetics 170 filled in the upper end of the cosmetic holder 140 through the upper supporting part (131*b*) exposed to the outside space of the raising and lowering operation tubular body 110.

For example, before an upper end of the cosmetics 170 is manipulated to appear outward, the entire cosmetics are located while being stored inside the upper supporting part (131*b*) of the protection tubular body 130. Therefore, even when the protection cap 160 is removed, the cosmetics can be safely protected, during appearing operation, the cosmetics may be raised and lowered while being safely covered with the upper supporting part (131*b*) (referring to FIG. 6).

Specifically, the upper supporting part (131*b*) of the protection tubular body 130 provides a remaining filled space in which the cosmetics is filled while the lower end of the cosmetics is partially stored in the filled space 143 of the cosmetic holder 140.

Meanwhile, the lower supporting part 131*a* of the protection tubular body 130 may include a first locking groove 131*a*-1 and a second locking groove 131*a*-2 formed on outer and inner surfaces thereof at a proper coupling distance, and a second locking protrusion 124*a* and a first locking protrusion 113 may be formed at a location of an outer circumferential surface of a coupling end tube 124 of the rotational tubular body 120 and a location of an inner circumferential surface of the raising and lowering operation tubular body 110 to correspond to each other, the locations corresponding to the first and second locking grooves, so that the locking grooves and the locking protrusions may be securely coupled to each other (referring to FIG. 4).

Herein, the first locking groove 131*a*-1 and the second locking groove 131*a*-2, and the second locking protrusion 124*a* and the first locking protrusion 113 may be formed at opposite locations to each other when necessary.

With the above-described structure, when the protection tubular body 130 is coupled to the raising and lowering operation tubular body 110, the first locking groove 131*a*-1 and the second locking groove 131*a*-2 of the lower supporting part 131*a* of the protection tubular body 130 are coupled to and supported by, in a caught state, the second locking protrusion 124*a* and the first locking protrusion 113 of the coupling end tube 124 and the raising and lowering operation tubular body 110 that are formed on corresponding locations. Therefore, the lower supporting part 131*a* of the protection tubular body 130 may be maintained in a stable coupling state between the raising and lowering operation tubular body 110 and the rotational tubular body 120, and thus arbitrary separation of the raising and lowering operation tubular body 110 and the rotational tubular body 120 can be prevented.

The vertical raising and lowering guide grooves 132 vertically formed on the opposite portions of the inner circumferential surface of the protection tubular body 130 to correspond to each other limit actually vertical movement distance and provide stable vertical movement of the cosmetic holder 140.

In other words, the raising and lowering ribs 142 of the cosmetic holder 140 fitted into the vertical raising and lowering guide grooves 132 move upward along the vertical raising and lowering guide grooves 132 and then step-caught thereby, so that the cosmetic holder 140 does not move upward no more and upward movement of the cosmetic holder 140 is limited. Furthermore, when the cosmetic holder 140 is manipulated to be raised or lowered, the cosmetic holder 140 slides in a state in which the raising and lowering ribs 142 at the opposite portion are fitted into the vertical raising and lowering guide grooves 132 of the protection tubular body 130, and raising manipulation of the cosmetic holder 140 with respect to the protection tubular body 130 may be stably performed, so that stable appearing manipulation of the cosmetics 170 in response to the raising manipulation of the cosmetic holder 140 is induced.

Furthermore, on opposite portion of the lower portion of the cosmetic holder 140 include the tension supporting pieces 146 with first locking steps 146*a* protruding outward on which the inner circumferential surface of the protection tubular body 130 moves in close contact therewith, and the tension supporting pieces 146 are formed by partially cutting the opposite portion of the lower portion of the cosmetic holder 140 so as to be elastically operated. The inner circumferential surface of the protection tubular body 130 on which the first locking steps 146*a* move in close contact therewith by a tension may include second locking steps 134, and when the cosmetic holder 140 moves upward to the highest point for appearing of the cosmetics 170, the first locking steps 146*a* go over the second locking steps 134 in sliding contact and are step-supported with each other.

Herein, the first locking steps 146*a* formed in the tension supporting pieces 146 of the cosmetic holder 140 and the second locking steps 134 of the protection tubular body 130 are preferably arranged in a perpendicular direction to locations where the raising and lowering ribs 142 of the cosmetic holder 140 and the vertical raising and lowering guide grooves 132 of the protection tubular body 130 are arranged, and the first locking steps 146*a* and the second locking steps 134 are also formed at locations where the first locking steps 146*a* go over the second locking steps 134 and are supported simultaneously when the raising and lowering ribs 142 are step-caught by the vertical raising and lowering guide grooves 132 of the protection tubular body 130.

Therefore, when the cosmetic holder 140 moves upward to the highest point, the first locking steps 146*a* formed in the tension supporting pieces 146 of the cosmetic holder 140 go over and are held by the second locking steps 134 of the protection tubular body 130 and are respectively caught by the vertical raising and lowering guide grooves 132, so that excessive upward movement of the cosmetic holder 140 is restrained.

Specifically, the tension supporting pieces 146 of the cosmetic holder 140 are operated in conjunction with the raising and lowering ribs 1432 of the cosmetic holder 140 fitted in the vertical raising and lowering guide grooves 132 of the protection tubular body 130, the vertical raising and lowering guide grooves 132 being arranged the perpendicular direction, thereby inducing more stable and balanced vertical movements of the cosmetic holder 140 with respect to the protection tubular body 130.

Furthermore, when the cosmetic holder is manipulated to be raised or lowered, the first locking steps 146*a* of the tension supporting pieces 146, which are formed at the opposite portions of the lower portion of the cosmetic holder 140, provide stable elastic adhesion to the inner circumferential surface of the protection tubular body 130, and when the first locking steps 146*a* go over the second locking steps 134 of the protection tubular body 130, as a sound or feeling of "clicking" generated by the elastic force of the tension supporting pieces 146 is provided, a user can know that the cosmetic holder 140 has been raised to the highest position. Accordingly, the user may provide an additional upward movement timing of the cosmetic appearing and disappearing manipulation and remaining cosmetic depletion guide tubular body 150 so as to deplete the cosmetics 170 remaining in the filled space 143 of the cosmetic holder 140.

Furthermore, as shown in FIG. 8, when the cosmetic appearing and disappearing manipulation and remaining cosmetic depletion guide tubular body 150 is lowered, the cosmetic holder 140 raised to the highest point is prevented from being lowered itself since the first locking steps 146*a* is held by the second locking steps 134 of the protection tubular body 130 in the step-locked state. As the rotational tubular body 120 rotates, only when the cosmetic appearing and disappearing manipulation and remaining cosmetic depletion guide tubular body 150 is manipulated to be lowered, the cosmetic holder 140 is lowered with the cosmetic appearing and disappearing manipulation and remaining cosmetic depletion guide tubular body 150, so that the cosmetics 170 can be stably fixed and supported.

Meanwhile, according to the present disclosure, the rotational tubular body 120 and the cosmetic holder 140 respectively may include third locking protrusions 126 and third locking grooves (148) that are formed to correspond to each other and are configured to be caught to each other. During product distribution or unintended external force, the cosmetic appearing and disappearing manipulation and remaining cosmetic depletion guide tubular body 150 spirally coupled to the spiral protrusion 122 of the rotational tubular body 120 is prevented from being arbitrary manipulated to appear and disappear by restraining arbitrary rotation of the rotational tubular body 120 due to the raising and lowering operation tubular body 110.

The third locking protrusions 126 and the third locking grooves (148) may be formed on locations opposite to each other when necessary.

As described above, even when an unintended external force is applied to the raising and lowering operation tubular body 110, rotation of the rotational tubular body 120 is prevented by the third locking protrusions 126 and the third locking grooves (148) provided in the configuration of the rotational tubular body 120 and the cosmetic holder 140. Therefore, the cosmetic appearing and disappearing manipulation and remaining cosmetic depletion guide tubular body 150 is prevented from being arbitrarily manufactured to be raised and lowered, thereby providing high assembly safety of products.

Furthermore, according to the present disclosure, at least one fixing rib 143*a* may be radially arranged on an inner circumferential surface of the filled space 143 of the cosmetic holder 140. Furthermore, at least one slit 152*a* may be formed by cutting the cosmetic supporting part 152 of the cosmetic appearing and disappearing manipulation and remaining cosmetic depletion guide tubular body 150 to correspond to the at least one fixing rib, so that the at least one fixing rib 143*a* is fitted into the at least one slit 152*a* (referring to FIG. 13).

With the configuration of the fixing ribs 143*a* described above, the cosmetics of which the lower end is partially filled in the filled space 143 may have more stable filling and fixing force. Furthermore, when the slits 152*a* formed in the cosmetic supporting part 152 of the cosmetic appearing and disappearing manipulation and remaining cosmetic depletion guide tubular body 150 is guided to move to the fixing ribs 143*a* in the raising operation, and thus a stable raising operation may be induced, and even when the fixing ribs are provided inside the filled space, it is possible to allow the outer circumferential surface of the cosmetic supporting part 152 to be raised and lowered in close contact with an inner circumferential surface of the filled space 143.

In the stick type cosmetic container 100 capable of depleting remaining cosmetics according to the present disclosure, general appearing and disappearing operations of the cosmetics 170 will be described.

FIGS. 4 and 5 are assembled-sectional views showing the protection cap 160 coupled to the raising and lowering operation tubular body 110 with the cosmetic holder 140 fully filled with the cosmetics 170. In this case, in the initial assembled state, a part of the lower end of the cosmetics 170 is fixed and supported inside the filled space 143, and the cosmetic holder 140, of which filling is supported while being held by the cosmetic supporting part 152 of the cosmetic appearing and disappearing manipulating and remaining cosmetic depletion guide tubular body 150, and the cosmetic appearing and disappearing manipulating and remaining cosmetic depletion guide tubular body 150 are assembled to each other to be raised and lowered together such that the engagement protrusion 155 of the raising and lowering supporting part 154 is engaged with the engagement grooves 145 formed in the engagement rib 144. Furthermore, the cosmetic holder 140 and the cosmetic appearing and disappearing manipulating and remaining cosmetic depletion guide tubular body 150 maintain a state where the spiral groove 156 of the raising and lowering supporting part 154 is lowered to the bottom end while being spiral-coupled to the spiral protrusion 122 of the rotational tubular body 120.

In addition, even when the cosmetic holder 140 and the cosmetic appearing and disappearing manipulating and remaining cosmetic depletion guide tubular body 150 move to the bottom end, the cosmetics 170 are safely covered and protected by the upper supporting part (131*b*) of the protection tubular body 130.

Therefore, during a product distribution process, the cosmetics 170 are safely protected by the protection tubular body 130 and the protection cap 160, and are protected from being exposed outward unless the protection cap 160 is arbitrarily opened.

In this state, when the user wants to apply makeup using the cosmetics 170, as shown in FIGS. 6 to 8, the protection cap 160 is removed, and then the rotational tubular body 120 rotates in conjunction with the raising and lowering operation tubular body 110 rotating in one direction (for convenience, counterclockwise), the cosmetic appearing and disappearing manipulating and remaining cosmetic depletion guide tubular body 150, to which the spiral groove 156 of the raising and lowering supporting part 154 is spiral-coupled, is vertically raised with respect to the spiral protrusion 122. Then, the cosmetic appearing and disappearing manipulating and remaining cosmetic depletion guide tubular body 150 is raised and at the same time the cosmetic holder 140 integrally engaged with the cosmetic appearing and disappearing manipulating and remaining cosmetic depletion guide tubular body 150 is also raised. By a raised distance, the cosmetics 170 filled in the filled space 143 of the cosmetic holder 140 is exposed outward from the upper supporting part (131*b*) of the protection tubular body 130 and the user can use the exposed portion to apply makeup.

Then, when the user puts the cosmetics 170 into the protection tubular body 130 after makeup is completed using the cosmetics 170, the cosmetic appearing and disappearing manipulating and remaining cosmetic depletion guide tubular body 150 is lowered as the raising and lowering operation tubular body 110 rotates in a reverse direction (for convenience, clockwise), and at the same time, the cosmetics 170 is again introduced into the upper supporting part (131*b*) of the protection tubular body 130 as the cosmetic holder 140 is also lowered.

Therefore, as described above, the cosmetics 170 is manipulated to appear and disappear from and into the upper supporting part (131*b*) of the protection tubular body 130 in response to a degree of raising and lowering rotation operation of the raising and lowering operation tubular body 110. Through this operation, the user can apply makeup while performing properly appearing and disappearing operation of the cosmetics 170.

Meanwhile, when the cosmetics 170 is operated to appear and disappear, the cosmetic holder 140 is possible to perform stable and balanced raising and lowering operation by the structure of the raising and lowering ribs 142 of the cosmetic holder 140 fitted into the vertical raising and lowering guide grooves 132 of the protection tubular body 130 or the structure of the tension supporting pieces 146. Accordingly, transverse moving or shaking of the cosmetics 170 can be prevented.

Next, after basic use of the cosmetics 170 filled in the filled space 143 of the cosmetic holder 140 is completed, an operation state to deplete the cosmetics remaining inside the filled space will be described with reference to FIGS. 9 to 12.

In order to deplete the cosmetics remaining in the filled space 143 of the cosmetic holder 140, first, the raising and lowering operation tubular body 110 is rotatably operated to raise the cosmetic holder 140 integrally engaged with the cosmetic appearing and disappearing manipulating and remaining cosmetic depletion guide tubular body 150 to the highest point first (referring to FIGS. 9 and 10).

Then, raising of the cosmetic holder 140 is stopped while the raising and lowering ribs 142 is step-caught by the vertical raising and lowering guide grooves 132 of the protection tubular body 130. In addition, the first locking steps 146*a* formed in the tension supporting pieces 146 of the cosmetic holder 140 forcibly go over the second locking steps 134 of the protection tubular body 130 and is held by an upper surface of the second locking steps 134. As described above, the cosmetic holder 140 is raised to the highest point, the upper end of the filled space 143 filled with the cosmetics 170 is exposed outward of the upper supporting part (131*b*) of the protection tubular body 130.

Meanwhile, as described above, the user can recognize the state where the cosmetic holder 140 is raised primarily to the highest point by the rotation operation of the raising and lowering operation tubular body 110 through the sound or feeling generated when the first locking steps 146*a* formed in the tension supporting pieces 146 go over the second locking steps 134 of the protection tubular body 130.

As described above, when the raising and lowering operation tubular body 110 continuously rotates in the same direction from a state in which the cosmetic holder 140 is raised primarily to the highest point stops, the cosmetic appearing and disappearing manipulating and remaining cosmetic depletion guide tubular body 150 is raised secondarily as an engagement force of the engagement protrusion 155 is forcibly released from the engagement grooves 145 of the engagement rib 144 of the cosmetic holder 140. Therefore, as described above, as the cosmetic appearing and disappearing manipulating and remaining cosmetic depletion guide tubular body 150 is operated to be raised secondarily separately from the cosmetic holder 140, it is possible to deplete a small amount of the cosmetics remaining in the filled space 143 (referring FIGS. 11 and 12).

Herein, as the cosmetic appearing and disappearing manipulating and remaining cosmetic depletion guide tubular body 150 raised secondarily allows the cosmetics to be freely raised secondarily within a range where the stopper 158 is caught by the lower end of the engagement rib 144 of the cosmetic holder 140, so that the cosmetics 170 remaining in the filled space 143 may be depleted. When the stoppers 158 is caught by the lower end of the engagement rib 144, a further raising of the cosmetic appearing and disappearing manipulating and remaining cosmetic depletion guide tubular body 150 is prevented. In this case, the upper surface of the cosmetic supporting part 152 ha be in at least the same horizontal level as the upper end of, the filled space 143, and the cosmetics remaining in the filled space 143 can be completed or be fully completed or removed.

Therefore, according to the present disclosure, as described above, the stick type cosmetic container 100 capable of depleting remaining cosmetic is configured such that, as the raising and lowering operation tubular body 110 is operated to rotate, the cosmetic holder 140 and the cosmetic appearing and disappearing manipulating and remaining cosmetic depletion guide tubular body 150 are operated to be raised within the range of the vertical raising and lowering guide grooves 132 of the protection tubular body 130, and the cosmetics 170 filled in the filled space 143 of the cosmetic holder 140 is possible to freely appear and disappear. Furthermore, when basic use of cosmetics is completed and then a small amount of cosmetics remaining in the filled space 143 is depleted, as the cosmetic holder 140 is raised primarily to the highest point of the vertical raising and lowering guide grooves 132 by the raising and lowering ribs 142 fitted into the protection tubular body 130 and then the cosmetic appearing and disappearing manipulating and remaining cosmetic depletion guide tubular body 150 is raised secondarily, it is very easy to completely deplete or remove the cosmetics 170 remaining in the filled space 143.

Meanwhile, according to the present disclosure, as shown in FIG. 14, except for the raising and lowering operation tubular body 110 and the protection cap 160, the rotational tubular body 120, the protection tubular body 130, the cosmetic holder 140, and the cosmetic appearing and disappearing manipulating and remaining cosmetic depletion guide tubular body 150 may be assembled into a single cosmetic filling unit (200).

The cosmetic filling unit (200) may be configured, as shown in FIGS. 15 and 16, such that the cosmetics 170 is top-filled (upper end filling) into the filled space 143 of the cosmetic holder 140 from the upper portion and then a separate airtight cap 210 covers and protects with the protection tubular body 130.

Furthermore, as shown in FIGS. 17 and 18, the filling through hole (153) is formed in the cosmetic supporting part 152 of the cosmetic appearing and disappearing manipulating and remaining cosmetic depletion guide tubular body 150, and the separate airtight cap 210 covers the protection tubular body 130 and then the cosmetics 170 may be back-filled (lower end filling) into the filled space 143 of the cosmetic holder 140 from the lower portion of the lower portion of the rotational tubular body 120.

As described above, when the cosmetics 170 is back-filled into the filled space 143 of the cosmetic holder 140, although not shown in the drawings, to prevent the cosmetics from drying and to prevent various foreign substances from entering a separate finish cap may be used to stable seal lower opening ends of the cosmetic appearing and disappearing manipulating and remaining cosmetic depletion guide tubular body 150 and the rotational tubular body 120 in order to prevent.

Therefore, as described above, the cosmetic filling unit (200) may be assembled to the raising and lowering operation tubular body 110 after being filled with the cosmetics 170 as an original product, or a single refill-product may be sold. When the cosmetic filling unit (200) is used as the refill product, the raising and lowering operation tubular body 110 and the protection cap 160 may be continuously used and thus various environment and economic advantages are provided.

Furthermore, the present disclosure has the structure that can completely complete or remove remaining cosmetics filled in the filled space 143 of the cosmetic holder 140, and when necessary, the used cosmetic container 100 and the cosmetic filling unit (200) are collected as is, then refilled with the cosmetics 170 from manufacturers, separate cosmetic stores, cosmetic refill shop, etc. and reused with simple washing or appropriate treatment.

Accordingly, the present disclosure is intended to cover not only the exemplary embodiments, but also various alternatives, modifications, equivalents and other embodiments that may be included within the spirit and scope of the present disclosure as defined by the appended claims

DESCRIPTION OF REFERENCE NUMERALS

110: raising and lowering operation tubular body 112: coupling rib
113: first locking protrusion 120: rotational tubular body
122: spiral protrusion 124: coupling end tube
124*a*: second locking protrusion 126: third locking protrusion
130: protection tubular body 131*a*: lower supporting part
131*a*-1: first locking groove 131*a*-2: second locking groove
(131*b*): upper supporting part 132: lowering guide groove
134: second locking step 140: cosmetic holder
142: raising and lowering ribs 143: filled space
143*a*: fixing ribs 144: engagement rib
145: engagement groove 146: tension supporting piece
146*a*: first locking step 148: third locking groove
150: cosmetic appearing and disappearing manipulating and remaining cosmetic depletion guide tubular body
152: cosmetic supporting part 152*a*: slit
153: filling through hole 154: raising and lowering supporting part
155: engagement protrusion 156: spiral groove
158: stopper 160: protection cap
170: cosmetics 200: cosmetic filling unit
210: airtight cap

The invention claimed is:

1. A stick type cosmetic container capable of depleting a remaining amount of cosmetics, the stick type cosmetic container comprising:

a raising and lowering operation tubular body (110); and a rotational tubular body (120) rotatably and separably coupled to and supported by an inside space of the raising and lowering operation tubular body (110), and comprising a spiral protrusion (122) on an hollow-type inner surface thereof;

a protection tubular body (130) of which a lower supporting part (131*a*) is fitted into the raising and lowering operation tubular body (110) to be separably coupled thereto and supported thereby, and at the same time, and an upper supporting part (131*b*) is configured to be exposed to an outside space to protect cosmetics (170) manipulated to appear and disappear, and vertical raising and lowering guide grooves (132) are formed on opposite portions of an inner circumferential surfaces of the lower supporting part (131*a*);

a cosmetic holder (140) slidably disposed between the rotational tubular body (120) and the protection tubular body (130), and at the same time, comprising raising and lowering ribs (142) perpendicularly protruding on opposite portions of an outer surface of a lower end thereof in a stepped shape, the raising and lowering ribs (142) being configured to be fitted to be vertically movable with respect to the opposite vertical raising and lowering guide grooves (132) of the protection tubular body (130) and when the cosmetics (170) is manipulated upward the raising and lowering ribs (142) being caught by the vertical raising and lowering guide grooves (132) to limit the upward movement, and comprising an engagement rib (144) formed in a stepped shape in a filled space (143) at an upper end of the cosmetic holder (140) in which a part of a lower end of the cosmetics (170) is filled while being fixed and engagement grooves (145) formed on opposite portions of an inner circumferential surface to face each other;

a cosmetic appearing and disappearing manipulation and remaining cosmetic depletion guide tubular body (150) provided through an inside space of the cosmetic holder (140), and comprising, while a cosmetic supporting part (152) supporting the lower end of the cosmetics (170) is seated on and caught by an upper portion of the engagement rib (144), a hollow raising and lowering supporting part (154) penetrating through and extended downward from a lower end of the cosmetic supporting part (152), and an engagement protrusion (155) protruding on an one side of an upper end of an outer circumferential surface of the raising and lowering supporting part (154) to be configured to be mutually engaged with the engagement grooves (145) of the engagement rib (144) in an appearing manipulation of the cosmetics (170), and to be separated from the engagement grooves (145) in remaining cosmetic depleting upward manipulation of the cosmetics (170), and a spiral groove (156) continuously formed at a lower end of the engagement protrusion (155) to be spirally coupled to the spiral protrusion (122) of the rotational tubular body (120) to enable raising and lowering manipulation, and a stoppers (158) provided on opposite portions of a flat second side outer circumferential surface of the raising and lowering supporting part (154) and configured to be mutually caught by a lower end of the engagement rib (144) to limit upward movement of the cosmetics (170) when residual amount of the cosmetics (170) remaining inside the filled space (143) of the cosmetic holder (140) is raised; and a protection cap (160) provided at an upper end of the raising and lowering operation tubular body (110) and configured to be manipulated to be opened and closed to protect the cosmetics.

2. The stick type cosmetic container of claim 1, wherein the rotational tubular body (120), which is coupled to and supported by the inside space of the raising and lowering operation tubular body (110), is rotatably and separably supported by mutual coupling between a coupling end tube (124) extended from a lower end of the rotational tubular body (120) and a coupling rib (112) extended upward from a bottom in the raising and lowering operation tubular body (110).

3. The stick type cosmetic container of claim 1, wherein the lower supporting part (131*a*) of the protection tubular body (130) further comprises a first locking groove (131*a*-1) and a second locking groove (131*a*-2) formed on outer and inner surfaces thereof at a proper coupling distance, and a second locking protrusion (124*a*) and a first locking protrusion (113) are formed at a location of an outer circumferential surface of a coupling end tube (124) of the rotational tubular body (120) and a location of an inner circumferential surface of the raising and lowering operation tubular body (110) to correspond to each other, the locations corresponding to the first and second locking grooves, so that the locking grooves and the locking protrusions are securely coupled to each other.

4. The stick type cosmetic container of claim 1, wherein tension supporting pieces (146) are formed to be elastically operated by partially cutting opposite lower portions of the cosmetic holder (140), and the tension supporting pieces (146) respectively comprise outward-protruding first locking steps (146*a*) moving in close contact with an inner circumferential surface of the protection tubular body (130).

5. The stick type cosmetic container of claim 4, wherein on the inner circumferential surface of the protection tubular body (130) on which the first locking steps (146*a*) of the tension supporting pieces (146) tension-moves in close contact therewith, in order to allow appearing and disappearing of the cosmetics (170), second locking steps (134) further protrude so that the first locking steps (146*a*) go over the second locking steps (134) in a slidingly contact manner, and step-supported, when the raising and lowering ribs (142) of the cosmetic holder (140) moves upward to the highest point along the vertical raising and lowering guide grooves (132) of the protection tubular body (130).

6. The stick type cosmetic container of claim 5, wherein the first locking steps (146*a*) formed in the tension supporting pieces (146) of the cosmetic holder (140) and the second locking steps (134) of the protection tubular body (130) are arranged in a perpendicular direction to locations where the raising and lowering ribs (142) of the cosmetic holder (140) and the vertical raising and lowering guide grooves (132) of the protection tubular body (130) are arranged, and the first locking steps (146*a*) and the second locking steps (134) are formed at locations where the first locking steps (146*a*) go over the second locking steps (134) and are supported simultaneously when the raising and lowering ribs (142) are step-caught by the vertical raising and lowering guide grooves (132) of the protection tubular body (130).

7. The stick type cosmetic container of claim 5, wherein in the cosmetic holder (140) with the raising and lowering ribs (142) moving upward to the highest point along the vertical raising and lowering guide grooves (132) of the protection tubular body (130), when the cosmetic appearing and disappearing manipulation and remaining cosmetic depletion guide tubular body (150) moves downward, as the first locking steps (146*a*) is supported while being step-caught by the second locking steps (134) of the protection tubular body (130), the cosmetic holder (140) is prevented from moving downward by itself, and simultaneously, by rotation of the rotational tubular body (120), the cosmetic holder (140) is configured to move downward together with the cosmetic appearing and disappearing manipulating and remaining cosmetic depletion guide tubular body (150) only in downward movement operation of the cosmetic appearing and disappearing manipulation and remaining cosmetic depletion guide tubular body (150), so that the cosmetic holder (140) is configured to stably perform fixing and supporting of the cosmetics (170).

8. The stick type cosmetic container of claim 1, wherein the rotational tubular body (120) and the cosmetic holder (140) respectively comprise third locking protrusions (126) and third locking grooves (148) that are formed to correspond to each other and are configured to be locked to each other, wherein during product distribution or unintended external force, the cosmetic appearing and disappearing manipulation and remaining cosmetic depletion guide tubular body (150) spirally coupled to the spiral protrusion (122) of the rotational tubular body (120) is prevented from being arbitrary manipulated to appear and disappear by restraining arbitrary rotation of the rotational tubular body (120) due to the raising and lowering operation tubular body (110).

9. The stick type cosmetic container of claim 1, wherein at least one fixing rib (143*a*) is radially arranged at an inner circumferential surface of the filled space (143) of the cosmetic holder (140), and a slit (152*a*) is formed by cutting the cosmetic supporting part (152) of the cosmetic appearing and disappearing manipulation and remaining cosmetic depletion guide tubular body (150), so that the fixing rib (143*a*) is fitted into the slit (152*a*).

10. The stick type cosmetic container of claim 1, wherein except for the raising and lowering operation tubular body (110) and the protection cap (160), the rotational tubular body (120), the protection tubular body (130), the cosmetic holder (140), and the cosmetic appearing and disappearing manipulation and remaining cosmetic depletion guide tubular body (150) are assembled into one cosmetic filling unit (200), and the cosmetic filling unit (200) is configured such that the cosmetics (170) is top-filled from an upper portion of the protection tubular body (130) into the filled space (143) of the cosmetic holder (140).

11. The stick type cosmetic container of claim 1, wherein except for the raising and lowering operation tubular body (110) and the protection cap (160), the rotational tubular body (120), the protection tubular body (130), the cosmetic holder (140), and the cosmetic appearing and disappearing manipulation and remaining cosmetic depletion guide tubular body (150) are assembled into one cosmetic filling unit (200), and the cosmetic filling unit (200) is configured such that a filling through hole (153) is formed in the cosmetic supporting part (152) of the cosmetic appearing and disappearing manipulation and remaining cosmetic depletion guide tubular body (150), an airtight cap (210) is coupled to an upper end of the protection tubular body (130), and then the cosmetics (170) is back-filled into the filled space (143) of the cosmetic holder (140) from a lower portion of the rotational tubular body (120).

12. A stick type cosmetic container capable of depleting a remaining amount of cosmetics, the stick type cosmetic container comprising:

a cosmetic appearing and disappearing manipulation and remaining cosmetic depletion guide tubular body (150) is configured to vertically raise with a spiral groove (156) of a raising and lowering supporting part (154), to which a spiral protrusion (122) of a rotational tubular body (120) rotating in conjunction with a raising and lowering operation tubular body (110) rotating in one direction is spiral-coupled, the cosmetic appearing and disappearing manipulation and remaining cosmetic depletion guide tubular body (150) is raised, and at the same time a cosmetic holder (140) separably engaged to the cosmetic appearing and disappearing manipulation and remaining cosmetic depletion guide tubular body (150) through an engagement rib (144) is configured such that raising and lowering ribs (142) are also raised within a range of a vertical raising and lowering guide grooves (132) of a protection tubular body (130), and cosmetics (170) filled in a filled space (143) of the cosmetic holder (140) are exposed outward of an upper supporting part (131*b*) of the protection tubular body (130) by a raised distance of the raising and lowering ribs (142), both the cosmetic appearing and disappearing manipulation and remaining cosmetic depletion guide tubular body (150) and the cosmetic holder (140) are lowered as the raising and lowering operation tubular body (110) rotates in a reverse direction, and thus as the cosmetics (170) are introduced into the upper supporting part (131*b*) of the protection tubular body (130), appearing and disappearing operation of the cosmetics (170) is properly performed, and when the cosmetic holder (140) is raised primarily to a highest point by the vertical raising and lowering guide grooves (132), by continuously rotating the raising and lowering operation tubular body (110) in one direction, the cosmetic appearing and disappearing manipulation and remaining cosmetic depletion guide tubular body (150) is configured to be raised independently secondarily while being released from an engagement force from the engagement rib (144) of the cosmetic holder (140) so as to push the cosmetics remaining in the filled space (143) to an outside space to deplete or remove the remaining cosmetics.

13. The stick type cosmetic container of claim 12, wherein in appearing and disappearing operation of the cosmetics (170), the cosmetic holder (140) is stabilized by a structure of the raising and lowering ribs (142) of the cosmetic holder (140) fitted in the vertical raising and lowering guide grooves (132) of the protection tubular body (130) and a structure of tension supporting pieces (146) with first locking steps (146*a*) that are arranged perpendicular to the raising and lowering ribs (142) and in elastically contact with an inner circumferential surface of the protection tubular body (130), so that balanced raising and lowering movements are possible.

14. The stick type cosmetic container of claim 12, wherein the cosmetic appearing and disappearing manipulation and remaining cosmetic depletion guide tubular body (150) raised secondarily is configured such that the stoppers (158) formed in the raising and lowering supporting part (154) is freely raised and lowered within a range of being held within the range of being locked at a lower end of the engagement rib (144) of the cosmetic holder (140), and configured to push the cosmetics (170) remaining in the filled space (143) to the outside space to deplete and remove the remaining cosmetics.

* * * * *